United States Patent [19]

Dumbaugh

[11] Patent Number: 4,774,893

[45] Date of Patent: Oct. 4, 1988

[54] SYSTEM OF HANDLING REFUSE DERIVED FUEL UTILIZING SAME TO FIRE POWER PLANTS

[75] Inventor: George D. Dumbaugh, Louisville, Ky.

[73] Assignee: Kinergy Corporation, Louisville, Ky.

[21] Appl. No.: 85,022

[22] Filed: Aug. 13, 1987

[51] Int. Cl.[4] ..... F23H 5/18

[52] U.S. Cl. ..... 110/186; 110/101 C; 110/101 CF; 110/347; 198/762; 198/771

[58] Field of Search ..... 110/101 R, 101 C, 101 CF, 110/108, 293, 186, 347; 198/762, 771

[56] References Cited

U.S. PATENT DOCUMENTS

| | | | |
|---|---|---|---|
| 3,178,068 | 4/1965 | Dumbaugh | 222/161 |
| 3,251,457 | 5/1966 | Dumbaugh | 198/220 |
| 3,261,592 | 7/1966 | Dumbaugh et al. | 259/2 |
| 4,378,897 | 4/1983 | Kattelmann | 198/771 X |
| 4,389,949 | 6/1983 | Heep | 110/101 CF |
| 4,480,560 | 11/1984 | Lennon | 110/101 R |
| 4,576,526 | 3/1986 | Muller et al. | 198/762 X |
| 4,690,076 | 9/1987 | Pelete, Jr. et al. | 110/238 X |

OTHER PUBLICATIONS

Bulk Solids Handling, vol. 4, No. 1, Mar. 1984, reprint of Article by G. D. Dumbaugh, "The Evolution of the First Universal Vibratory Drive System for Moving and Processing Bulk Solid Materials", pp. 125–140.

Resource Recovery, No. 3, Sep. 1987, Article "From Cash Burner To Trash Burner", front cover sheet and pp. 5–10, 58 and 59, by Michael D. Long.

*Primary Examiner*—Edward G. Favors

*Attorney, Agent, or Firm*—Mann, McWilliams, Zummer & Sweeney

[57] ABSTRACT

A system for handling refuse derived fuel (RDF) devised to make RDF fired power plants practical, that includes a method and apparatus for receiving, storing and discharging, distributing and feeding RDF at the plant that accepts such material for fuel, which has been shredded to a predetermined nominal size and usually has most of the ferrous metals removed therefrom, which system includes a relatively large activated bin for primary surge capacity purposes that initially receives and stores the RDF, to provide a binned quantity of same from which as continuous flow of the RDF can be generated that will result in a pulsation free, steady supply of RDF to the plant furnace or furnaces, for firing the power plant involved, with one or more trains located adjacent the locale of the plant furnace to be fired, each of which includes several metering activated bins that are actuated to supply an underlying vibrating feeder that conveys the RDF to the furnace fuel chute, with the activated metering bins of each train being supplied from by one, or parallel, vibrating conveyors. For some trains, two metering bins can be provided for redundancy, that is, for the purpose of using either of such bins to supply the RDF to the vibrating feeder underlying same in the event that one of such activated bin arrangement does not operate.

26 Claims, 10 Drawing Sheets

SYSTEM OF HANDLING REFUSE DERIVED FUEL UTILIZING SAME TO FIRE POWER PLANTS

This invention relates to a system of handling refuse derived fuel (RDF) for supplying same to RDF fired power plants for purposes of generating heat for forming steam, for heating and electricity providing functions. More particularly, to an RDF system, that in supplying RDF to RDF fired plants, results in the fuel feed to the plant furnace being steady, uniform and pulsation free with the RDF being continuously supplied to the furnace fire chamber or pit in a fluffed condition for maximized heat generation purposes for burning, and at a volume rate that is in proportion to pressure or temperature sensed within the furnace boiler, with the system involved being free from manual cleaning requirements, RDF return conveyor requirements, or any need for gates.

Refuse derived fuel is municipal solid waste made up of garbage and trash picked up by collection vehicles operated by municipal solid waste disposal services.

The nature of RDF makes the handling of same for any purpose extremely difficult. For instance, its density is low (3–10 pcf), its moisture content varies (10–30%), and it is made up of irregularly shaped particles. RDF basically consists of burnable trash and garbage (of both content) that normally, for use as fuel, is shredded to define individual pieces of a specified nominal size, such as six inches in size or less. This type of matter includes paper, cardboard, rags, pieces of wood, garbage such as banana peelings, apple cores, other normally edible vegetables and fruits that have been disposed of, normally edible meats that have been disposed of, and other items ordinarily found in trash or garbage such as crushed aluminum cans, recording tapes, coat hangers, electrica wire, or the like, just to mention a few.

For many years the familiar common way to dispose of this so-called municipal solid waste has been to bury same in land fills, but it is now common knowledge that land fills are not only becoming scarce in terms of availability, but previously filled land fills are frequently identified as the culprits for contaminating water in the areas where they are located.

RDF fired power plants have been proposed for the purpose of generating steam, for instance, for the supplying of heat and electricity, because of the great amount of municipal solid waste that is continuously created at major metropolitan centers and the difficulty of otherwise satisfactorily permanently disposing of same. RDF fired power plants are called "waste to energy" facilities because they hopefully will convert the nuisance waste to a beneficial power producer.

However, existing RDF handling equipment employed for this purpose has been found to be not suitable for various reasons that the Applicant has determined relates to the manner and the amount that the RDF is supplied to the furnace feed chutes for combustion purposes, and the fact that the RDF handling systems suggested to date require the equipment involved be shut down regularly, or at least irregularly, for cleaning purposes if the overall system is to continue operating with reasonable heat generation.

For instance, a requirement that has now become mandator for RDF fired power plants is that the RDF be supplied to the plant furnace fire chamber or pit on a continuous, steady basis, free of pulsations or minute interruptions. Auger type feeders innately provide a pulsating type of discharge since their output is sinusoidal, and "drag" type conveyors define pockets to provide for the fuel flow with the similar pulsating results due to the fact the moved RDF fuel tends is to agglomerates in the aft portion of the individual pockets involved, causing the discharged output of such conveyors to "pulse" slightly. It is these minute "pulses" of the auger and drag type conveyors that are to be avoided to insure that the RDF feed to the furnace fire chamber or pit is continuous. Furthermore, when RDF is "pushed" forward by either auger or drag-type conveyors, the RDF involved tends to inherently compress or to "wad" or, in other words, compact. It is well known that RDF, when it is presented in the furnace fire chamber or pit, should be very loose and thus "fluffed" to provide for effective burning in the furnace and maximized BTU generated per pound of RDF burn.

It has also been found that auger and drag type conveyors in acting to feed the RDF material become fouled with some of the components of the RDF material involved, such as the various forms of ribbons, dictaphone tapes, music tapes, electric wires or cable, and the like, wrapping around the shafts of augers and fouling drag conveyor component parts. This heretofore has required complete shut down of the system for manual cleaning, on at least an irregular basis.

The present invention is concerned with a system for handling RDF employing vibrating equipment, which system keeps the RDF "unwadded" or "fluffed", eliminates any accumulation of the long stringers in the fuel that have been previously encountered, and thus does not require any shut down of the system for manual cleaning, and which stores at the plant and discharges from the storage site and feeds automatically the RDF to the furnace fire chamber in response to a signal generated within the furnace boiler itself that may be based on pressure, temperature, or any other suitable criteria.

Before discussion of the basic approach that is taken by the present invention, a few definitions well known to those versed in the vibratory drive system arts will be useful as background for defining various aspects of the present invention.

Conveying type vibratory units "oscillate" or "vibrate" with a "back and forth" motion to beneficially move or transport most solids to achieve a useful material handling function in which the individual particles of bulk material being fed are moved or conveyed over a surface by means of a series of "hops". The total "back and forth" distance displacement is called "stroke", and one-half of the stroke is "amplitude" each "hop" is a cycle, and the distance "hopped" is directly related to stroke, with the "hops" per unit of time being the operating frequency (cycles per unit of time, usually a minute). The speed, or how fast the "back and forth" motion occurs, is called "frequency" (which is also frequently expressed as cycles per minute). The vibratory stroke action has the same acceleration in both directions of its "back and forth" motion, and the part which carries or conveys the bulk material is generally known in this field as the trough, pan, deck, or in connection with vibrating screens, the "screen body". The total motion generator is the "vibratory drive system".

Conveyors in this field that are known as vibratory or vibrating conveyors typically provide the distance transport function of bulk solid materials; they are usually of long length (ten to three hundred feet or thereabouts), they are usually constant and in output, and are normally subjected to reasonably uniform loading.

On the other hand, what are known as vibratory or vibrating feeders perform a bulk material feed or proportioning function. They are usually relatively short in length (typically less than fifteen feet), and almost always have some means of adjusting their rate of output (as in tons per hour or TPH). They are designed to successfully contend with head loads and/or at least some abusive loading.

Activated bins are complete vibrating bins in the sense that the entire bin assembly that is supported on vibration oscillators, such as solid rubber oscillators, that are equipped with one or more vibratory exciters, and that are usually equipped with top covers that may be formed to define an intake port and a lower discharge gate that is associated with the bin outlet.

With the foregoing in mind, a principal object of the present invention is to provide a system of handling RDF that comprises methods and apparatus for making it practical to fire power plants with RDF by providing for the handling of RDF at the plant in supplying same to the plant furnace or furnaces in the form that, despite the variant and unlikely nature of RDF insofar as acting as a fuel is concerned, in a steady, pulse free, flow conditioned to constitute the RDF as it is presented in the furnace fire chamber to burn with maximized efficiency, which apparatus does not require regular or even irregular manual cleaning of the fuel conveying equipment involved. The term "handling", in this connection means receiving, storing and discharging, distributing, and feeding (of RDF).

Another principal object of the present invention is to provide methods and apparatus for handling RDF for use in power plants in "firing" the plant that provides a realistic, practical and essentially fail-safe way of converting a nuisance and otherwise hard to dispose of waste to a beneficial power producer.

Yet another principal object of the present invention is to provide a system, for handling RDF, methods and apparatus directed to accumulating the RDF at a particular plant location as the RDF is delivered to the plant, and utilizing vibrating or vibratory storage, distributing, metering, and automatically operated feeding equipment to provide for a steady flow of the RDF into the furnace fire chamber or pit, which flow is kept free of minute interruptions or pulsations, and the handling of the RDF insures conditioning of the RDF for maximized BTU output per pound of same burned, which system also avoids the need for "return" conveyors should some of the RDF not enter the metering activated bin that is located at the locale of the power plant furnace in question, should some of the RDF not enter such metering bin at the time it is initially presented for discharge into the indicated metering bin, and avoids the need to make manually clean the RDF handling equipment involved.

Still another object of the invention is to provide activated or vibrating bins that are specifically adapted to accept RDF, and on vibration thereof, provide for ready discharge of the RDF therefrom for distribution or flow metering purposes.

A further principal object of the present invention is to provide a vibrating equipment train arrangement to be located at the locale of a RDF fired power plant furnace that includes at least one metering activated bins and an associated vibrating RDF feeder. When two such unit assemblies are used, this permits either one of the metering bins involved to be used as part of the handling system, if one of the bins involved fails in service for some reason, to fail-safe supply the needed RDF to an adjustable feed rate vibrating feeder that in turn supplies same in steady flow form to the RDF fired furnace at a flow rate that is in proportion to the generation of heat as sensed by sensing pressure or temperature within the boiler to hold the burning process that heats the boiler substantially constant.

Still a further principal object of the invention is to provide a vibrating conveyor arrangement for each of the activated metering bins employed for conveying the accumulated RDF in a steady flow from a location of primary storage to the respective activated metering bins, while providing the option of supplying only the metering bin that is functioning should the other bin malfunction, and also providing the vibrating conveyor with a form of RDF discharge gate that both physically acts on the RDF to avoid wadding or matting of same, and that permits the RDF to pass over the outlet to a filled metering bin and move on to the next succeeding train if there is one, or await discharge into the metering bin in question when it has room to receive the excess RDF, thus avoiding the need for so-called "return conveyors", or any need for gates.

Another principal object of the invention is to provide a vibrating feeder that is equipped along the feed path define by same with RDF dewadding devices to maintain and enhance the loose or fluffy nature of the RDF that is to be supplied to the RDF fired power plant furnace in question, and which provides a steady flow of RDF to the furnace fired chamber that has its feed rate proportioned to the heat actually being generated at the furnace fired chamber, in accordance with a control arrangement for controlling the voltage applied to the feeder vibrator motor in response to a signal generated in the furnace boiler by sensing pressure or temperature.

An important object of the present invention is to provide a practical way of bringing into use RDF fired power plants, by providing an essentially fail-safe system of handling RDF at the plant involving vibrating equipment that is inexpensive of manufacture, that is basically of tried and true capability, but which has been modified specifically for handling RDF, and that as a system provides for the storage of RDF at the plant with surge storage capacity, as well as distribution of the stored RDF to the locale or locales of the plant RDF fired furnaces, without exhausting the primary stored quantity of RDF, and the supply of the RDF to the furnace fired chamber in a steady flow, as well as in a state for maximized BTU emission per pound on burning, and at a flow rate that is proportioned to the pressure or temperature within the furnace boiler resulting from the indicated burning of the RDF, with the equipment involved requiring no manual cleaning, and being very energy efficient and long lived in operation, and tolerating repeated and rapid starts and stops, eliminating the need for operating gates, and not having any components in the RDF flow stream that wear or require maintenance.

In accordance with the invention, the system of handling RDF involved contemplates equipping power plants to be fired with refuse derived fuel (RDF), and more specifically to have their furnace or furnaces fired by RDF. The system contemplates from the overall method standpoint that the municipal solid waste forming RDF be collected at the RDF fired plant, as by way of being dumped onto the so-called "tipping" floor by the individual vehicles typically employed to collect municipal garbage and trash. The municipal solid waste involved is then conventionally shredded and usually passed under an electromagnet to remove most of the ferrous metal. As conventionally shredded, RDF is usually at a nominal six inch size, but it can be reduced down to, with higher shredding costs, a two inch nominal size or less if so desired. The shredded municipal solid waste is, or may be, the components of ordinary municipal solid waste, such as paper, cardboard, rags, garbage in the form of disposed of fruits, vegetables, and meat, crushed aluminum cans, pieces of wood, ribbons and long slivers in the form of electrical wire lengths, shredded plastic items, rags, or the like.

In the practice of the invention, the RDF that has been shredded to a predetermined nominal size and usually has had the various ferrous metals removed therefrom, is stored in a large activated bin that provides the needed primary surge capacity for full storing the RDF as it is received from the indicated shredding and ferrous metal removal processing, with the resulting RDF being conveyed to the inlet port of a relatively large activated storage bin that is proportioned to hold, or bin (store), for instance, a quantity of the fuel in the range of from about 1,000 to about 3,000 cubic feet. This relatively large activated bin serves as the primary surge storage means of the system and is located in the plant to serve one or more of the furnaces, as arranged in accordance with details of the invention, to, when automatically and cycle type vibrated as hereinafter disclosed, discharge through the lower outlet of same, by way of vertically spaced baffle arrangements of inverted conical configuration mounted in the bin that are apertured to accommodate gravity flow of RDF therefrom, on exciting of the bin vibrating mechanism or mechanisms.

The invention further contemplates that the primary storage providing activating bins discharge the RDF into one or more vibrating conveyors, each having a so-called subresonant tuned spring vibratory drive system with "free force" input, that convey the RDF at a flow rate that does not significantly deplete the RDF stored in the primary bin, to one or more RDF feed trains disposed at the locale of the plant furnace and comprising at least one but can be two metering activated bins that are capable of supplying a quantity of the RDF to a vibrating feeder which not only meters the fuel flow but which has its flow path include one or more devices to keep the RDF in a fluffy state as it approaches the furnace fire box or pit feed chute served by same. Preferably the primary storage activated bin is arranged to provide RDF to several vibrating conveyors that convey and thus distribute the RDF involved to multiple feed trains remotely located in the plant facilities from the primary storage activated bin, or the vibrating conveyors involved may receive their RDF from separate primarly storage activated bins at different locations within the plant, all of which are vibrated (to feed the RDF therefrom) only when the depth of the RDF being conveyed in such vibrating conveyors falls below a predetermined level, as sensed by a sensing device located, for instance, in the conveyor inlet port.

In any event, it is preferred that each of the vibrating feed trains that are located at the locale of a plant furnace include one or preferably a pair of the metering activated bins so that if one of such metering bins fails to work, the other metering bin can be relied upon for this purpose, whereby the RDF feed to be supplied to the train vibrating feeder is continuous. The RDF supplied to the non-functioning metering bin will then be moved downstream onto a downstream located metering bin, or simply be dead ended. Also, the vibrating feeders should be of the so-called sub-resonant tuned spring vibrating drive system with "free force input" type referred to with regard to the vibrating conveyors (of the system of this invention), as distinguished from the other three vibratory systems that are available, namely the "single input" (brute force) type, the electromagnetic type, or the "natural frequency" type involving natural frequency turned drive springs combined with an eccentric crankarm input.

The invention contemplates that in the normal situation each furnace at its locale will have from two to five feed trains, with one or two parallel vibrating conveyors involved that serve the respective sets of metering activated bins (which also may be in the range of 2 to 5, or 4 to 10, per train), each being equipped with special discharge ports at the underside of their troughs that enable the RDF to cross over a discharge port should the metering bin below same be filled, and move on to the next adjacent conveyor discharge port, where the RDF may discharge into the bin underlying same if that bin has room for additional RDF or cross over such port and move to the next conveyor discharge port of that metering bin being filled. All the discharge ports of the vibrating conveyors are configured to allow the fuel passing over same maintain the fluffy nature of the RDF as it passes thereby. The system further contemplates that the RDF may dead end at the last outlet of the respective vibrating conveyors involved, and the respective vibrating conveyors will simply keep on running without any drive system damage. When the metering bin below the most downstream port becomes available for discharging fuel, the fuel that has started to back up will then discharge through the vibrating conveyor outlet port involved, thus avoiding the need for so-called "wrap around" or return conveyor systems to route the excess RDF back to its original storage source or for refeeding same to the conveyor discharge ports.

The invention further contemplates that for the individual vibrating trains, the activated metering bins, which are of relatively small storage, capacity, provide a surge capacity for the vibrating feeders that are respectively below same and which meter the supply of the RDF to the furnace feed chutes. In accordance with the invention, these metering activated bins have a capacity in the range of from approximately 100 to about 400 cubic feet, and again are provided with vibrating arrangements of the type hereinafter disclosed as well as vertically spaced baffle arrangements of inverted conical configuration that are apertured to accommodate gravity flow of the RDF therefrom on exciting of the vibrating mechanism employed in connection with the indicated metering bins. Each of the metering activated bins is provided with a sensing arrangement for the flow or lack thereof of RDF in the vibrating feeder serviced thereby which controls in an "off-on" nature the vibration of the respective metering bins. The arrangement is such that when the RDF flow of the vibrating feeder is below a predetermined level, the particular metering bin involved will vibrate to discharge RDF therefrom into the vibrating feeder, and when the RDF flow in the feeder has reached a predetermined depth, the vibrating device of the metering bin will discontinue its operation.

The invention further contemplates that the vibrating apparatus that actuates the respective vibrating feeders involved will be automatically controlled by a sensing arrangement that varies the voltage supplied to the vibrator motor in proportion to the pressure, temperature, or any other suitable factor, sensed within the furnace boiler or combustor involved to arrange that the individual vibrating feeders supply to the furnace feed chute the RDF at a feed rate that will produce the proper amount of BTUs of the per pound of RDF burned in the furnace fire box or chamber.

As indicated, the arrangement of the invention is such that the feed of the RDF to a particular furnace fire box or pit is steady, with the RDF being maintained in a "fluffed" condition resulting in a maximized generation of heat that acts on the boiler in a more or less steady state manner. Furthermore, the vibrating system involved for handling the RDF is self cleaning, and does not require manual effort to clear it of stringers, coat hangers, tapes, or ribbon like material that is inevitably to be found in RDF and that gets caught and fouls other types of RDF handling systems. The system also eliminates the need for operating gates at the various system outlets.

Other objects, uses, and advantages, will be obvious or become apparent from a consideration of the following detailed description and the application drawings, in which like reference numerals indicate like parts throughout the several views.

In the drawings:

FIG. 1 is a diagrammatic elevational view illustrating schematically and diagrammatically the basic aspects of a specific RDF handling system in accordance with the invention for supply of RDF to RDF fired power plants, with the system involved as illustrated shown to be serving two plant furnaces that are shown in block diagram form at the left hand and right hand lower ends of FIG. 1;

FIG. 2 is the same sort of view as Fgure 1, taken along line 2—2 of FIG. 1, showing diagrammatically and schematically the right hand end feed train of the vibrating equipment arrangement of FIG. 1 and the furnace feed chute that it services, also diagrammatically indicating the manner of controlling the output operation of the vibrating feeder involved in accordance with temperatue or pressure sensed within the furnace boiler with conventional electrical controls such as fuses, linestarters, and the like being omitted for simplicity;

FIG. 3 is a vertical sectional view, partially in elevation, with parts broken away, of a two motor vibratory assembly equipped activated bin arrangement that is of the general type that may be employed and proportioned to serve as the primary storage bin or as the metering activated bin of the present invention, with the activated bin illustrated in FIG. 3 showing in section internally spaced and apertured baffling suitable for application to either type of bin, in accordance with the invention;

Figure 1:
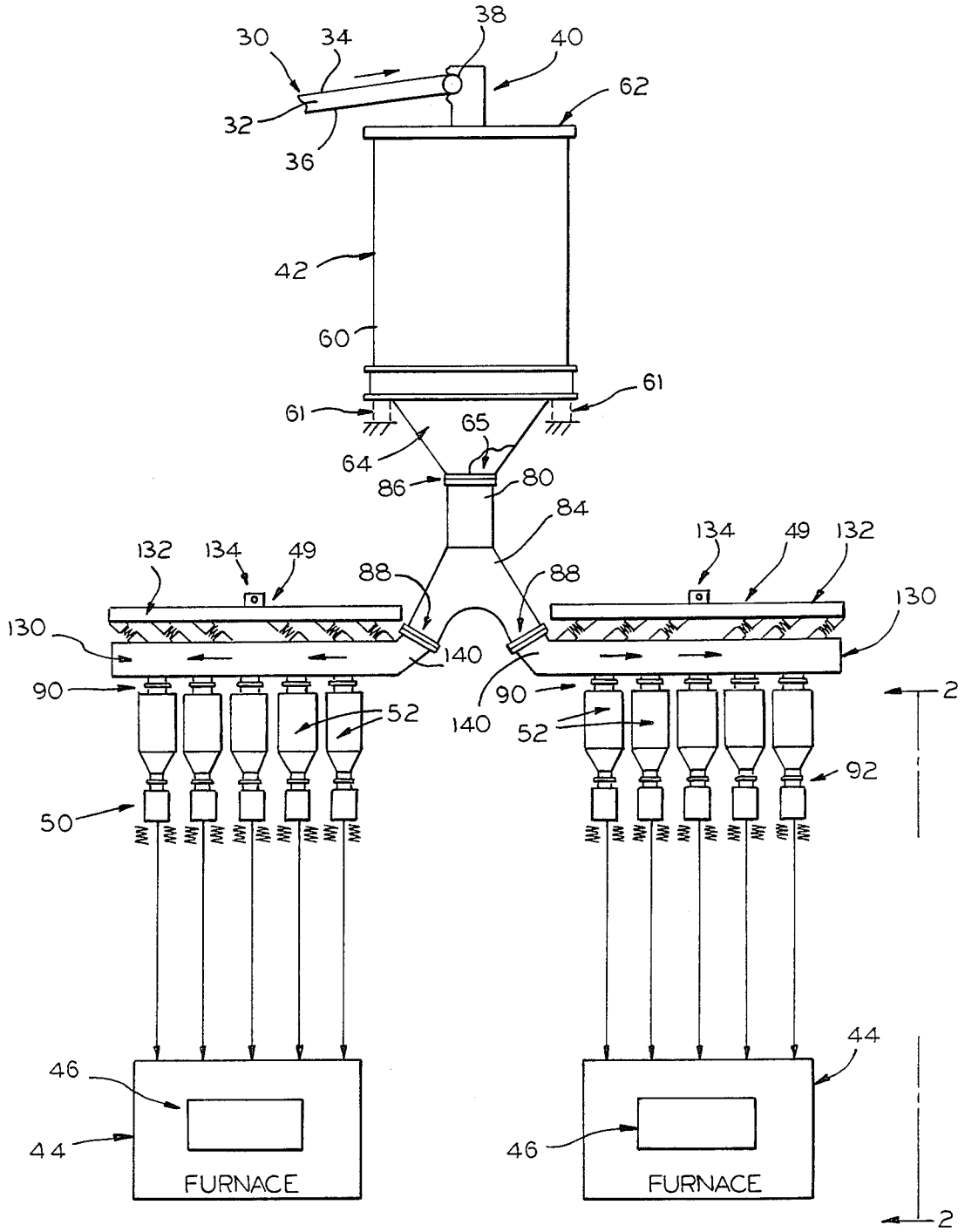
Figure 12:
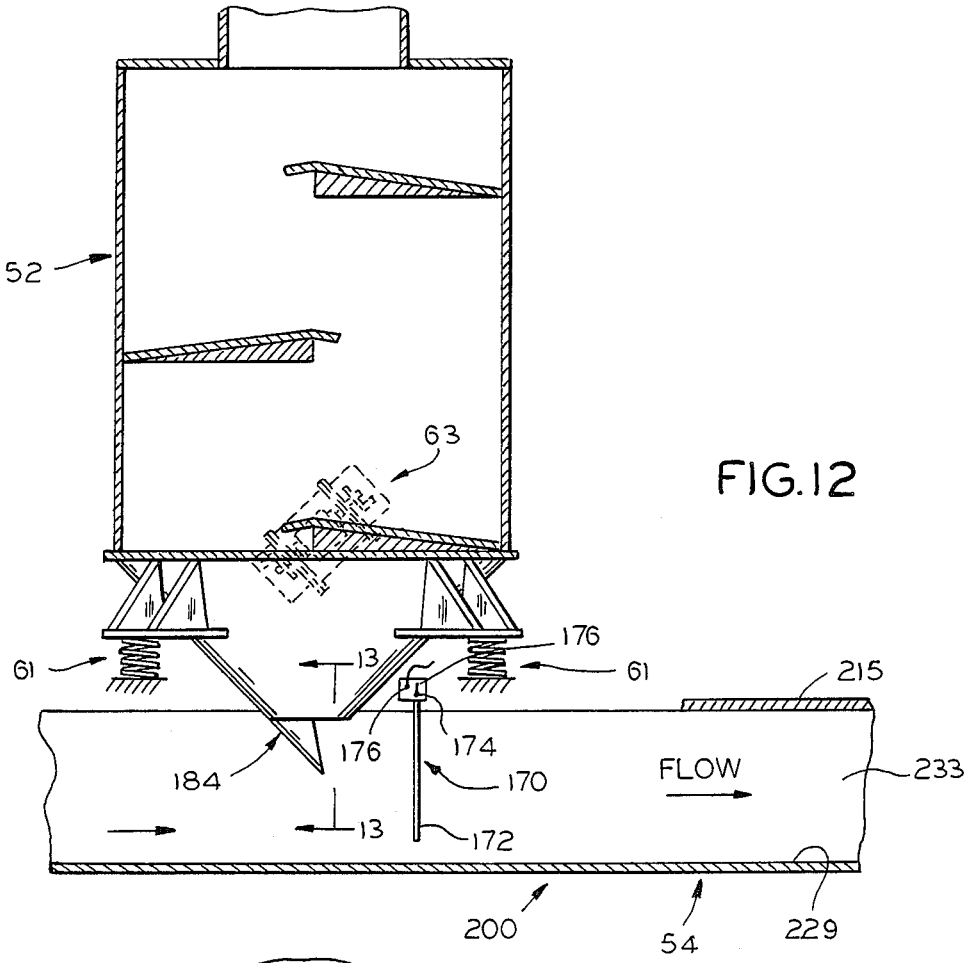
Figure 13:
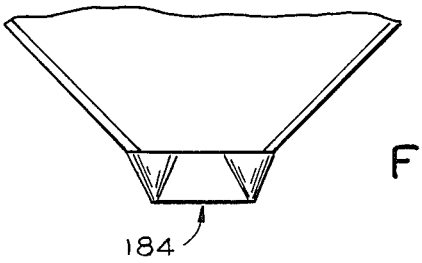
Figure 13A:
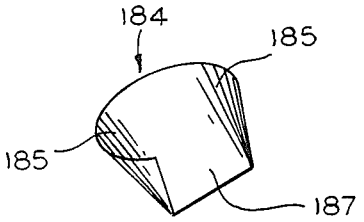
Figure 14:
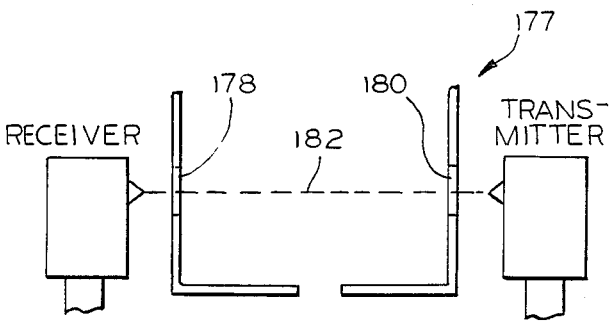
Figure 15:
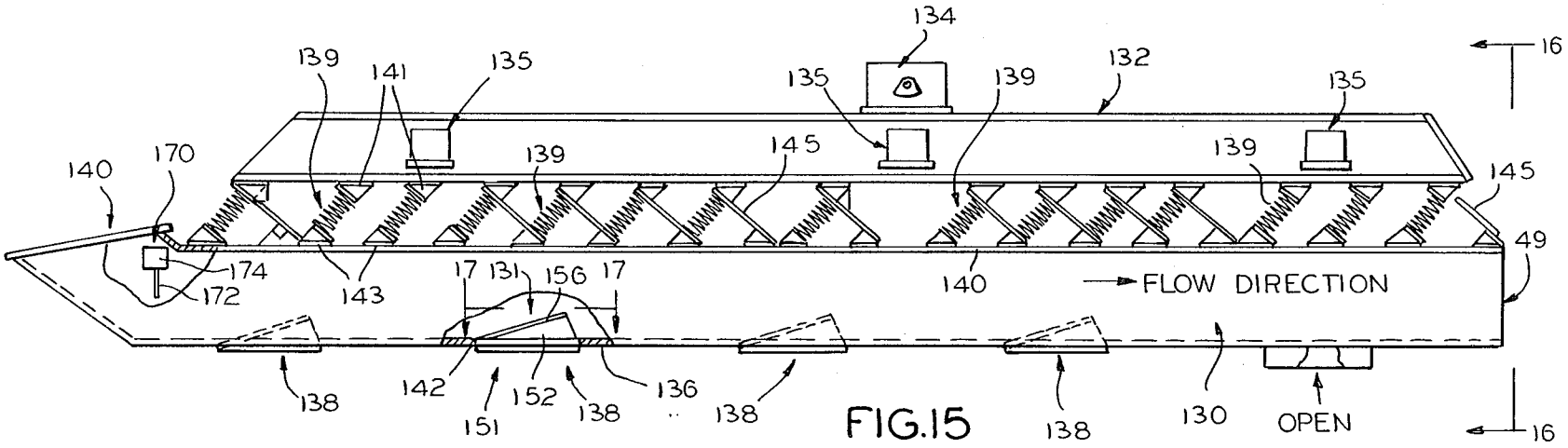
Figure 18:
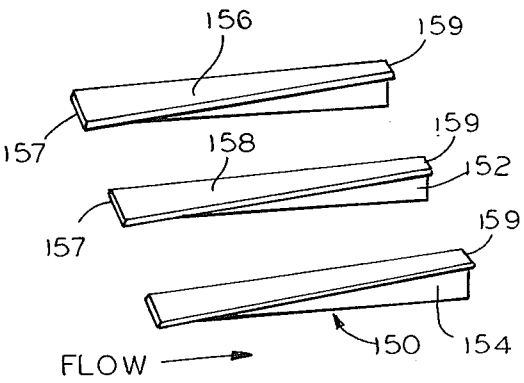
Figure 17:
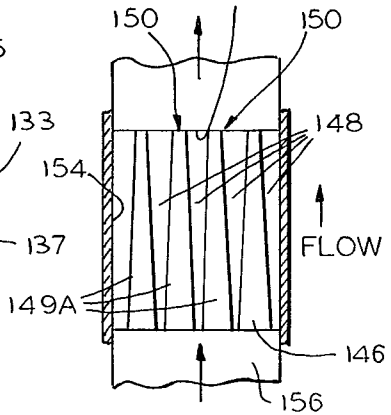
Figure 16:
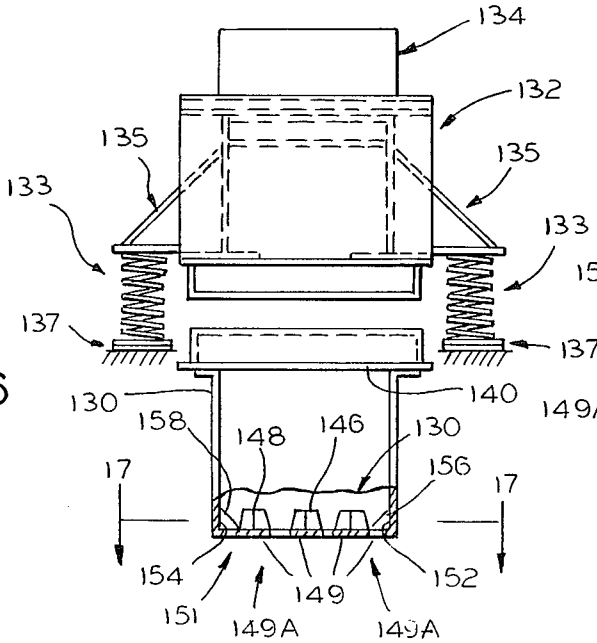
Figure 19:
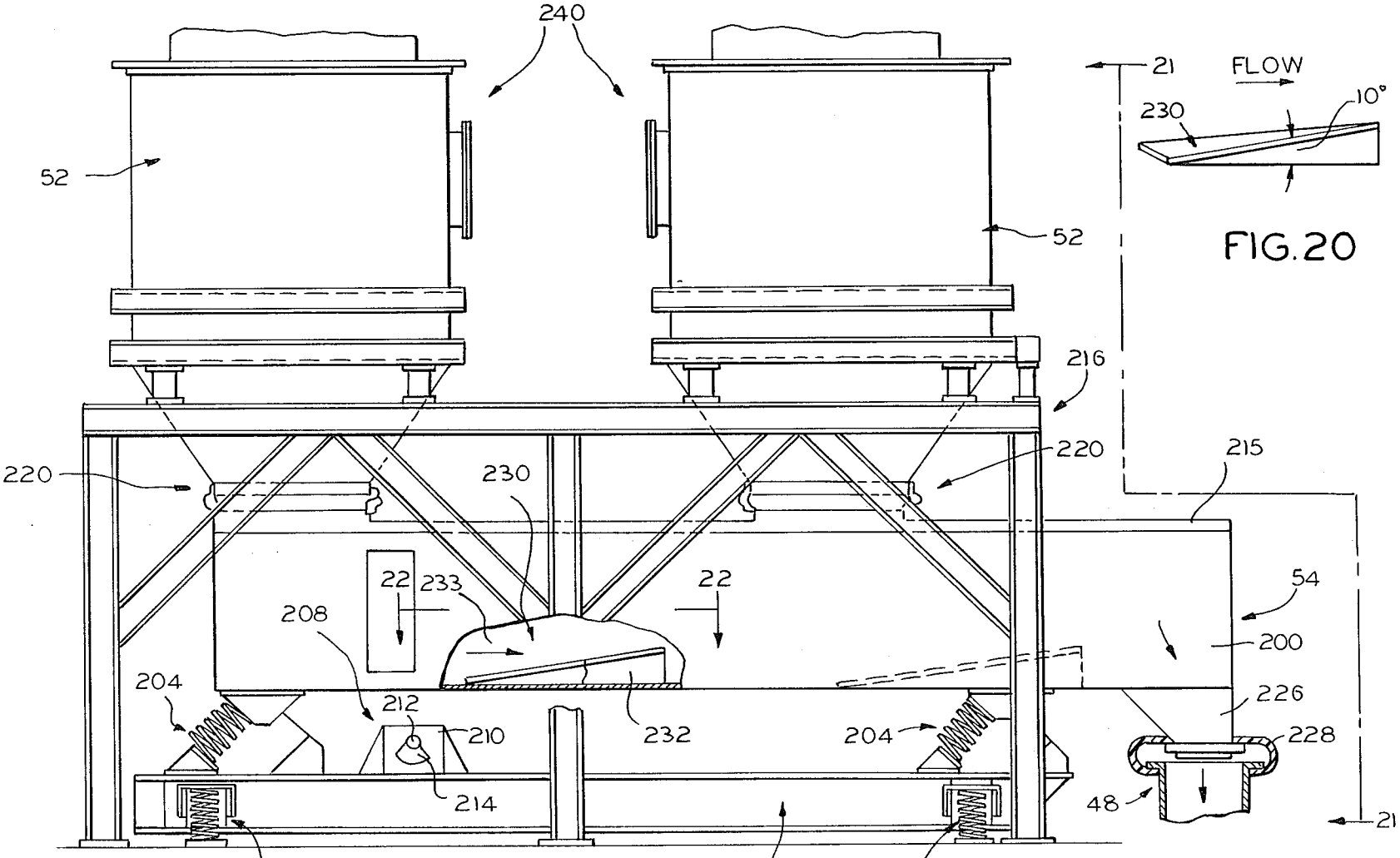
Figure 21:
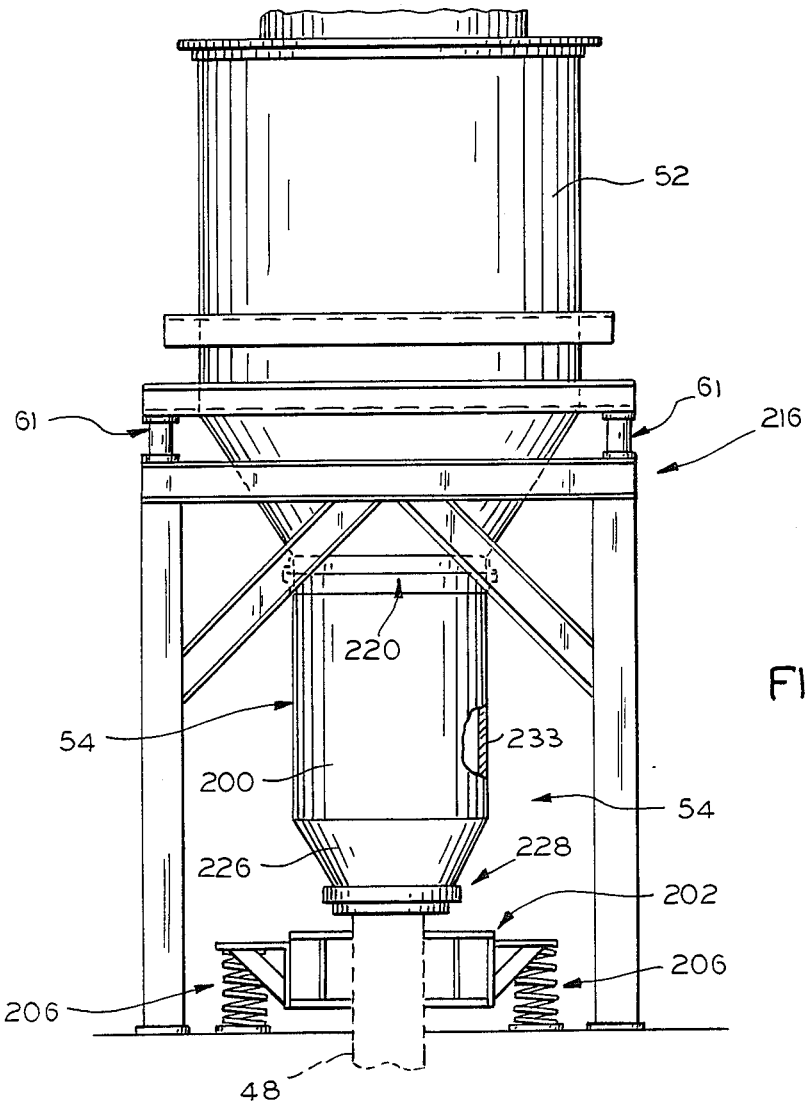
Figure 22:
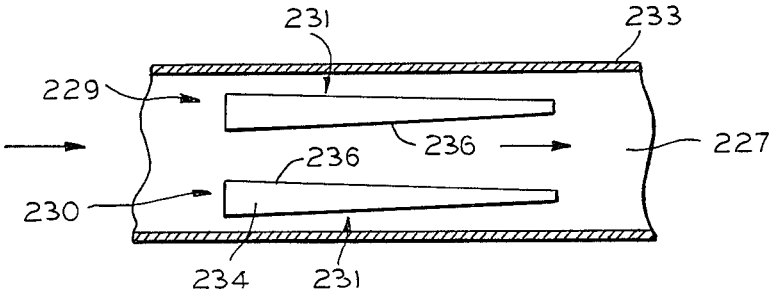
Figure 23:
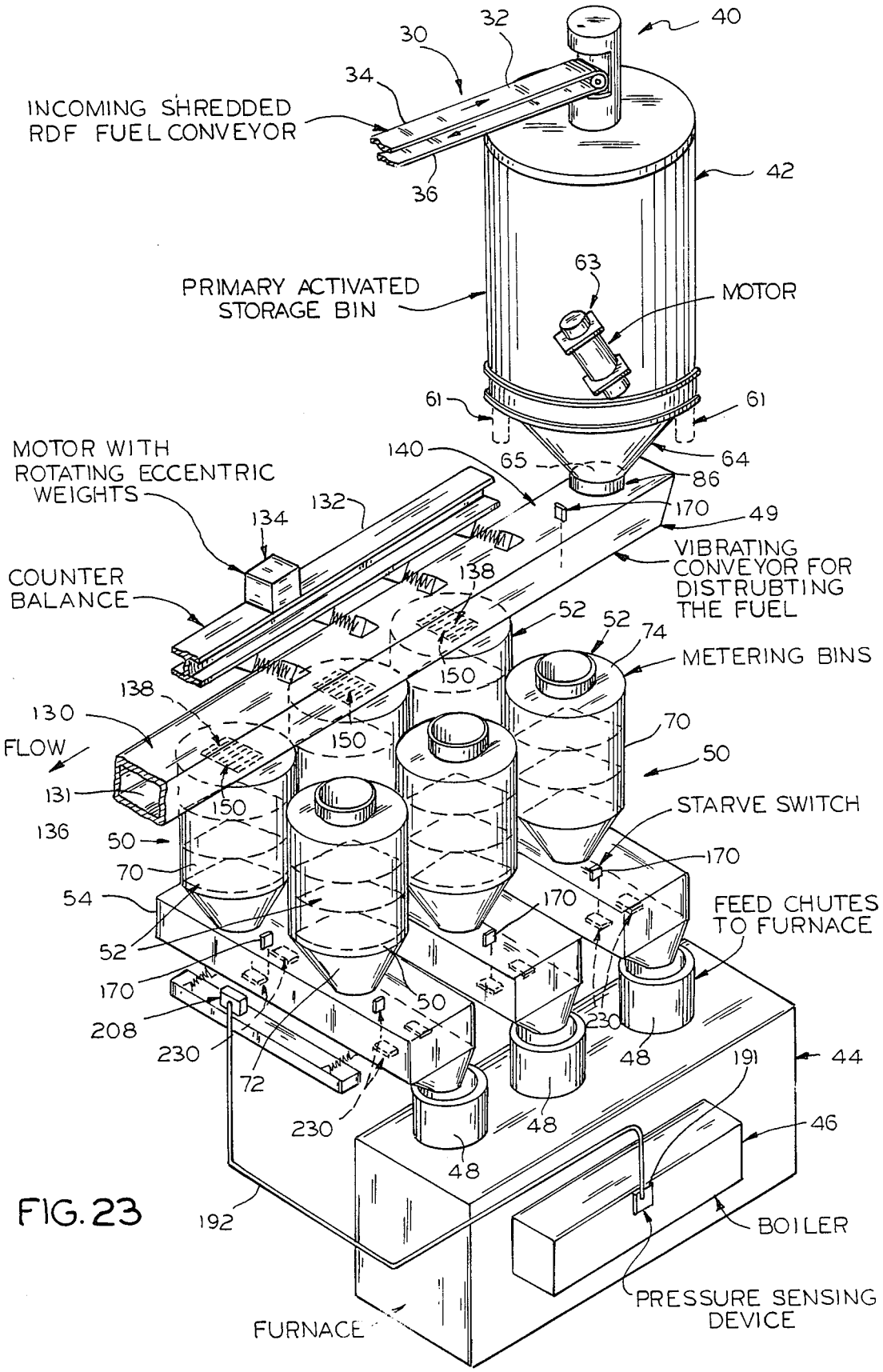

FIG. 12 is a diagrammatic cross-sectional view of an activated metering bin in accordance with the invention operably associated with a vibrating feeder of the invention and forming one of the aforementioned feed trains, with the train's activated metering bin illustrated being the downstreammost activated metering bin of the train involved when two such bins are employed, illustrating several important details of construction including a diagrammatically illustrated "starve" switch for "off-on" controlling the vibratory action of the metering bin illustrated, and showing in side elevation a "sugar scoop" type of chute that is affixed to the upstream side of the outlet of the illustrated activated bin for RDF discharge directional providing purposes at this location;

FIG. 13 is an enlarged fragemental vertical sectional view taken substantially along line 13—13 of FIG. 12 illustrating a full elevational view of the special chute that is part of the discharge port on the activated bin of FIG. 12;

FIG. 13A is a fragmental perspective view of the sugar scoop type of chute that is applied to the metering bin of FIG. 13;

FIG. 14 illustrates a modified form of activated metering bin vibrating control arrangement of the "off-on" type of the familiar electrical (photoelectric eye) type;

FIG. 15 is an enlarged side elevational view of the up side down type, fuel distributing, vibrating conveyor shown at the right hand side of FIG. 1, diagrammatically illustrating the conventional features of same, and indicating the preferred location in its trough of fuel depth sensing devices of the types shown in FIGS. 12 and 14, and indicating also the location of the improved RDF outlet intermediate discharge ports that are formed in the bottom or under portion of the trough of same, with parts broken away;

FIG. 16 is an end elevational view of the vibrating conveyor shown in FIG. 15, with the conveyor counterbalance mounted isolator springs being diagrammatically illustrated;

FIG. 17 is a fragmental horizontal sectional view, taken substantially along line 17—17 of FIG. 15, illustrating in top plan view style one of the improved RDF discharge ramps that are formed over each of the conveyor intermediate outlets in the vibrating conveyor of FIG. 16 in accordance with the present invention;

FIG. 18 is a diagrammatic perspective view of the ramp arrangement that is present at each intermediate RDF discharge port of the vibrating conveyors employed in accordance with the present invention;

FIG. 19 is an elevational view of a so-called "feed train" assembly employed in accordance with the present invention, the showing of FIG. 19 more completely illustrating the specific component parts involved, and with parts broken away;

FIG. 20 is a side elevational view illustrating one of the RDF "fluffing" ramps employed on one side of the vibrating feeder of the train shown in FIG. 19, and in accordance with the invention;

FIG. 21 is an end elevational view of the vibrating feed train shown in FIG. 19, taken substantially along line 21—21 of FIG. 19;

FIG. 22 is a fragmental horizontal sectional view taken substantially along line 22—22 of FIG. 19, illustrating one of the sets of ramps that are employed in accordance with the present invention along the bottom or floor of the trough of the vibrating feeders arranged in accordance with the present invention; and FIG. 23 is a fragmental perspective view illustrating a simplified overall embodiment of the invention and is presented as a generic representation of the basic nature of the Applicant's RDF handling system and the methods and apparatus involved.

However, it is to be distinctly understood that the specific drawing illustrations provided are supplied primarily to comply with the requirements of the Patent Laws, and that the invention is susceptible of numerous other embodiments or modifications that will be readily apparent to those skilled in the art, depending upon the particular needs of the power plant to be serviced by the invention, and which are intended to be covered by the appended claims.

GENERAL DESCRIPTION

As has been indicated, the invention is concerned with the adaptation and use of more or less conventional vibratory equipment for the purpose of handling RDF at RDF fired power plants, as the Applicant has found equipment of the type illustrated and modified as hereindisclosed best suited to insure that the storing, distributing, and ultimate feeding of the RDF to the furnace fuel feed chute is in a flow that is steady and free of pulsation, that the furnace fuel that is deposited in the furnace feed chute is in the "fluffy" condition (as distinguished from being wadded) for having maximized heat generation on being burned in the furnace fire box or pit, and that the RDF handling system involved is in effect self cleaning and does not require manual efforts to clean it from fouling by such RDF commonly encountered components such as stringers, coat hangers, tapes, or ribbon like materials that tends to get caught in the equipment employed in other types of RDF handling systems.

There have been previous efforts to devise ways and means of handling RDF to provide a practical type of RDF fired power plants. For this purpose augers and drag type conveyors have been employed, which have been found by the Applicant to be unsatisfactory because the resulting equipment assembly does not provide the desired steady flow of RDF to the furnace fire box or pit, it tends to compact or wad the RDF, thus adversely affecting its burnability, and the entire system must be shut down periodically to manually clean it from RDF components which inherently get through the initial RDF shredding procedures, but which tend to wrap around or otherwise foul the conveying equipment involved.

The basic procedures that have already been suggested for handling RDF at RDF fired power plants prior to the storing, distributing and feeding of same to the plant furnace (or furnaces) involve the municipal solid waste (that is to form the RDF) being picked up by the usual municipal garbage-trash collection trucks and dumped, as the RDF comes in, on the facility power plant "tipping" floor, from which the RDF is passed through a suitable shredder that normally reduces the size of the individual components of the RDF to a nominal six inches, although the shredding can proceed to the point where the nominal dimension is approximately two inches or less, if so desired, with correspondingly increased shredding costs. The nominal six inch size is an average size that is encountered in the shredding of the RDF although up to fifteen percent or so of the RDF can be found to be in the form of ribbons of less than six inches in width, but having lengths that may vary from about eighteen inches to about eight or ten feet (the latter somehow passing through the shredder apparatus without being further reduced in length). In any event, thereafter the RDF is usually passed under a suitable electromagnet arrangement to remove most of the ferrous metals that may be in the RDF. Thereafter the RDF in the condition indicated is transported by conveyor to the furnace area of the plant building. It is after the RDF has been shredded (and possibly has had most of the ferrous metal removed therefrom) that the RDF handling system of the present invention becomes applicable and provides basic improvement involved.

Referring now more specifically to FIGS. 1 and 23, the RDF is applied to a suitable conventional belt conveyor 30 or the like, in which the belt conveyor 30 comprises a suitable endless belt 32 that is suitably trained to define upper run 34 and lower or return run 36, with the belt 32 being trained over suitably journalled end pulley 38 that effects, in accordance with the present invention, deposit or dropping of the RDF into suitable intake conduiting 40 that communicates with the interior of a relatively large articulated storing bin 42 that provides a primary surge capacity storage of the RDF supplied to the system of the instant invention, in light of the fact that the RDF is periodically delivered in the manner indicated to the plant serviced by the invention and processed for application to the system of the present invention, which system supplies such fuel in the form of a steady feed to a plant furnace, such as the furnaces 44 diagrammatically illustrated in FIGS. 1 and 23.

In this connection it will be understood, of course, that power plant furnaces adapted to burn RDF will vary widely in nature, but each furnace will include one or more fire boxes or chambers and vertically disposed feed chutes leading thereto to which the RDF is to be supplied to burn in the furnace fire box or chamber to supply the heat that acts on the furnace boiler (diagrammatically illustrated at 46 in FIGS. 1 and 23) in which steam is created by the heat generated by the burning of the RDF, for purposes of heating and/or generating electricity, or the like. Such conventional furnaces normally have vertically disposed feed chutes of the type diagrammatically illustrated at 48 in FIGS. 2 and 23. Normally at the lower end of the chutes 48 there is a sloping section that slopes at approximately 45 degrees to convert the movement of the fuel from vertical to horizontal, and at this point the fuel is typically subjected to a continuous blast of air to blow the RDF into the furnace fire box or chamber, though, of course, some other suitable means could be used. These features are not illustrated as they are conventional and are not concerned with the present invention.

In this connection, in this art the term "furnace" is generally understood to mean an apparatus for the production or application of heat, and the term "boiler" is generally understood to mean the part of the steam generator of power plant furnaces that is heated by the fire in the furnace fire chamber and in which the water supplied thereto is converted into steam (for heating, electricity generation, and/or other purposes), and which comprises usually metal shells, headers, and tubes that form the container or containers for the water supplied thereto and the steam emitting therefrom. As is well known in the art, the furnace may have stoker lined boilers, fluid bed combustors, incinerators with steam making capabilities, or the like. The term "boiler" as employed in this disclosure has such meaning.

Figure 2:
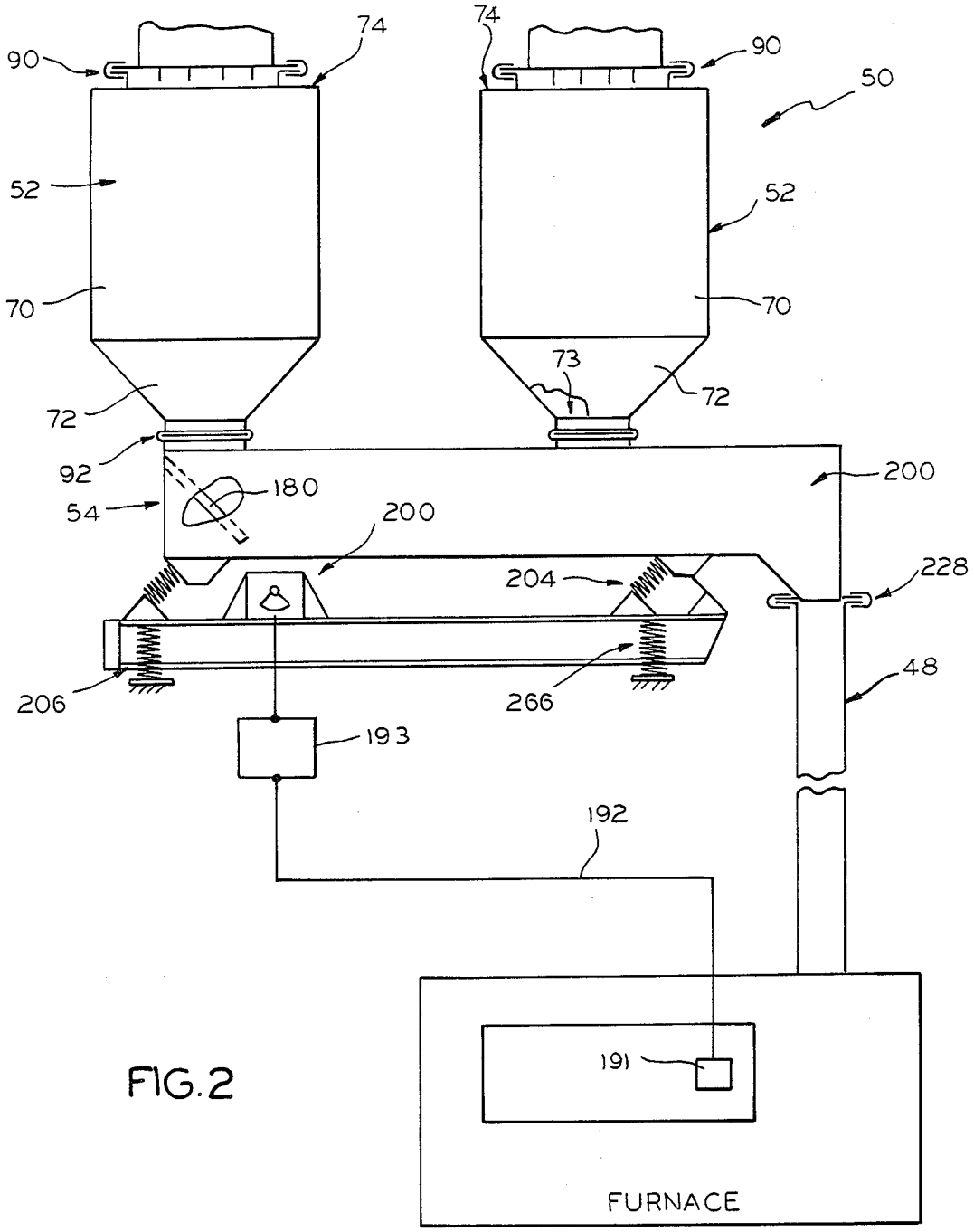

In accordance with the present invention, for any particular furnace, the RDF accumulating in the storage activated bin 42 is discharged to an upside down type vibrating conveyor 49 that moves the RDF to the locale of the furnace to be serviced by the system, at which locale are appropriately mounted a number of vibrating feeder trains 50 arranged in accordance with the present invention, each of which includes at least one but often two metering activating bins 52 that are separately supplied by parallel fuel distributing vibrating conveyors 49 (not shown in FIG. 1, but see the redundancy arrangement of FIG. 23), with such bins 52 singly or collectively supplying RDF as needed to the feeders 54 to provide a steady fuel flow to the respective vibrating feeders 54 that convey the RDF to the respective furnace feed chutes 48, as indicated in FIGS. 2 and 23.

Further, the quantitive output of the vibrating feeders 54 is controlled through an arrangement that controls the voltage applied to the alternating current motor of the vibrating drive system involved in each unit 54 in accordance with my U.S. Pat. No. 3,251,457 (the disclosure of which is hereby incorporated herein by this reference), based on an electrical control arrangement sensing either the temperature, pressure, or other suitable condition within the boiler 46 that is to be heated by the burning of the RDF.

SPECIFIC DESCRIPTION

The activated bins 42 and 52 and associated parts may be basically conventionally arranged to be a single motor bin activator or a two motor bin activator, but are modified as disclosed herein with regard to their internal baffling and the mounting of their activating motors. My prior U.S. Pat. No. 3,178,068 discloses a two motor bin actuator of the type that will serve the purpose when modified in accordance with the present invention, while my prior U.S. Pat. No. 3,261,592 discloses a single motor bin activator in the same category. The necessary bin modifications are indicated in FIGS. 3–11 of the instant application. The disclosures of my said U.S. Pat. Nos. 3,173,068 and 3,261,592 are hereby incorporated herein by this reference.

Figure 3:
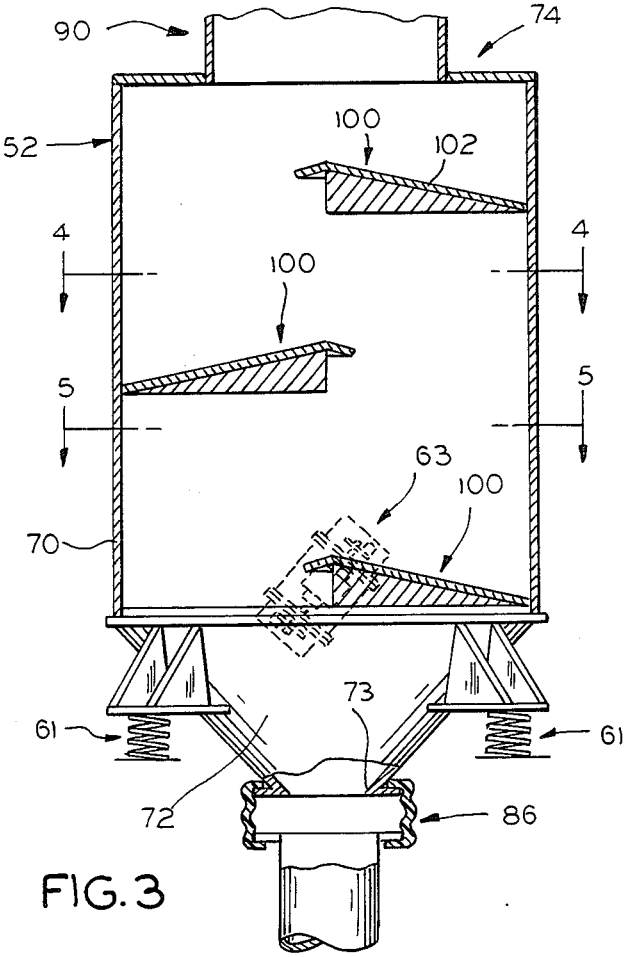
Figure 5:
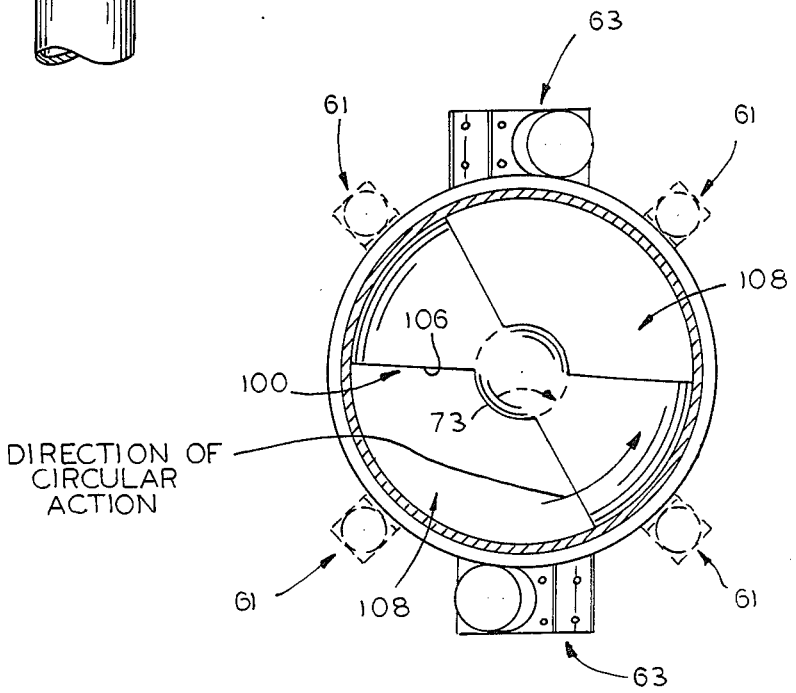
FIG. 5 is a transverse cross-sectional view substantially along line 5—5 of FIG. 3.

The relatively large primary storage activating bins 42 preferably have a capacity in the range of from about 1,000 cubic feet to about 3,000 cubic feet and define an upright vertical wall 60 that may, for instance, be twelve feet in diameter and twenty feet high and rests on suitable vibration isolators 61, which may be of the rubber type, such as the type diagrammatically illustrated in my prior U.S. Pat. No. 3,173,068 (shown diagrammatically in FIGS. 1 and 23). The bins 42 also include a suitable cover or top 62 to which the intake conduit 40 is suitably connected or affixed for discharge of the incoming RDF into the large storage bins 42. At the lower end of the large bin side wall 60 a suitable transitional discharge cone 64 of frusto-conical configuration, and defining the usual bin discharge opening 65, is provided.

Where the activated bin 42 is of the two motor type, the bin driving motor assemblies 63, which include the usual equipment excitors involved with three hundred sixty degrees of rotation (see my U.S. Pat. No. 3,173,068), are mounted on diametrically opposite sides of the bin, and on the bin vertical side wall 62, in the same manner as indicated in FIGS. 3 and 5. Typically, each motor of an assembly 63 should be mounted so that the bottom of the motor is flush with the bottom break line of the bin, which is the point of connection of the cone 64 to the bin.

As to the smaller metering activated bins 52, it is suggested that they be of from about 100 to about 150 cubic feet size in internal capacity. As indicated in FIGS. 2 and 23, the bins 52 each comprise vertical side wall 70 that is secured to a suitable degree angle discharge cone 72 that is of frustoconical configuration and defines the outlet 73 of the respective bins 52, as well as suitable top 74. The cone 72 slopes to an outlet of approximately two feet in diameter, as compared to the preferred three foot diameter outlet for the storage bins 42.

The outlets of the primary storage bins 42 are flexibly connected in any suitable manner, such as by employing conventional flexible socks and skirts, to the troughs of the vibrating conveyors 49, while the troughs of the vibrating conveyors 49 are also similarly flexibly connected to the tops of the metering activated bins 52. The metering bins 52 in turn are similarly suitably flexibly connected to the vibrating feeders 54 that they service.

In the showing of FIG. 1, the primarly storage container 42 is shown flexibly connected to the respective vibrating conveyors 49 there illustrated by, suitable fuel flow stream splitting suction 84 being suitably flexibly connected to the primary storage bin 42, as at 86, and to the troughs of the respective conveyors 49 by suitable flexible connections 88. The metering activated bins 52 are connected at their upper ends to the respective vibrating conveyors 49 by suitable flexible connections 90, with the discharge ports of bins 52 being suitably flexibly connected to he vibrating feeders 54 that they service by suitable flexible connections 92. The discharge outlets of feeders 54 are similarly flexibly connected, as at 93 (see FIG. 2) to the furnace feed chutes 48.

In this connection it is preferred that the Applicant's RDF system of handling be enclosed throughout so as to be essentially dust free in operation.

As has been indicated, the smaller metering bins 52 are part of the individual store-feed trains 50 for a particular furnace 44. In the showing of FIG. 1 there is a line up of five of the trains 50 to feed RDF to five different locations along the length of the furnace 44 at each side of the figure to heat the boilers 46. The diagrammatic showing of FIG. 23 shows three such trains for the furnace 44 there illustrated, but in this view the left hand side of the apparatus is broken away for facilitating understanding of the overall arrangement involved.

As has been previously indicated, in accordance with the present invention, the activated bins 42 and 52 are equipped internally with insert baffles that are in the nature of apertured frusto-conical members in inverted relation. The purpose of these baffles is to cause the "flake" particles of RDF to orient horizontally in layers, as opposed to aligning vertically, which, without the baffles, tends to deter vertical flow of the RDF through the bin. The baffles also minimize wadding of the RDF while it remains in storage.

Figure 4:
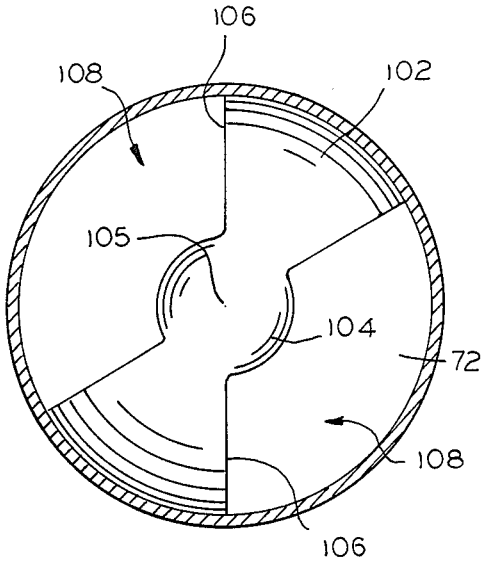
FIG. 4 is a transverse cross-sectional view substantially along line 4—4 of FIG. 3.

The specifics of one form of the bin baffle is shown in FIGS. 3, 4 and 5 in connection with a two motor type bin, and while the bin there illustrated is of the smaller metering capacity type, the same principles are applicable to the larger storage bins 42, as partially shown in FIGS. 1 and 23.

In the showing of FIGS. 3, 4 and 5, the bin 52 there illustrated is intended to represent a metering bin in accordance with the present invention equipped with three similar, vertically spaced baffles 100 that are welded in place or otherwise suitably secured, to the bin vertical side wall 70, and comprise members 102 of frusto-conical configuration defining a central frusto-conical head portion 104 that is aligned with the vertical central axis 105 of the bin, with the individual baffles 100 being apertured as at 106 on either side of same (see FIG. 4), to define enlarged feed through openings or ports 108. As indicated in the showing of FIG. 3, the baffles 100 are not only vertically spaced, but vertically succeeding baffles 100 there illustrated are oriented relative to the baffle of same at ninety degrees with respect to same, so that the feed through openings 108 defined by each baffle 100 are not aligned. When the activated bins 42 and 52 are vibrated in the manner that will result when they are equipped with the oppositely disposed motor-vibration units 63 indicated in FIGS. 3 and 5, a short reversing circular action occurs in the bins which tends to feed the RDF fuel about the respective baffles and into the respective feed through openings 108 to get a good feed through of the RDF material through the bin. However, experience has shown that for some applications the baffles 100 are congruently located, one above the other.

In this connection, it is pointed out that in accordance with the present invention, it is preferred that the large storage bins 42 be two motor activated bins equipped in the manner indicated in FIGS. 3–5, while the metering activated bins 52 may be either of the one or two motor type. In either case, in accordance with the invention, bins 42 and 52 are to be vibrated only when the RDF flow in the vibrating conveyor or feeder serviced by same is below a given level, as will be described in detail hereinafter. The vibrating exciters 63 of the bins 42 and 52 thus operate periodically, depending on the level of flow of the RDF in the vibrating conveyor or feeder that is fed by same, as herein disclosed.

The metering bins 52 may typically be on the order of five feet in diameter by eight feet high lengthwise of the vertical wall 70, with the cone 72 sloping at least 45 degrees to an outlet of approximately two feet in diameter that is centered with respect to the vertical central axis 105 of the bin 52.

Figure 9:
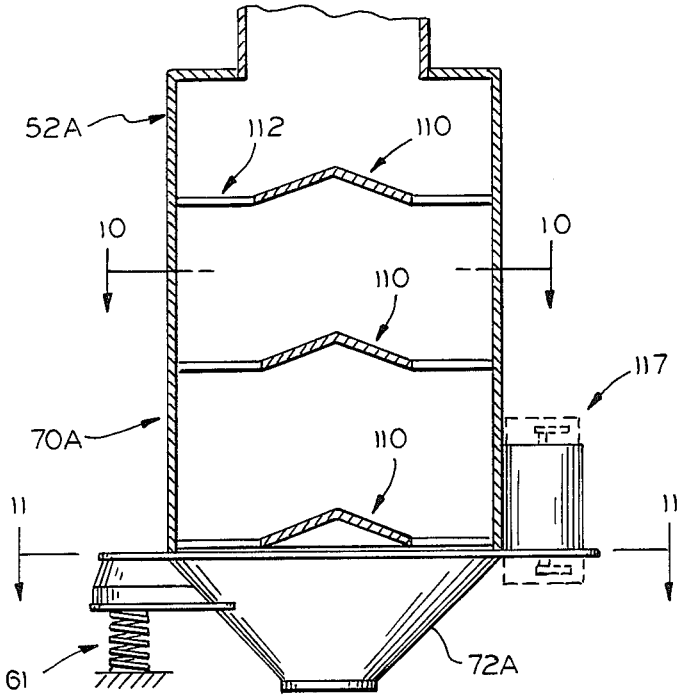
FIG. 9 is a view similar to that of FIG. 3 illustrating an activated bin arrangement of the single motor type, with the internal baffling illustrated being of the type employed for either of the invention primary storage or metering bins.
Figure 10:
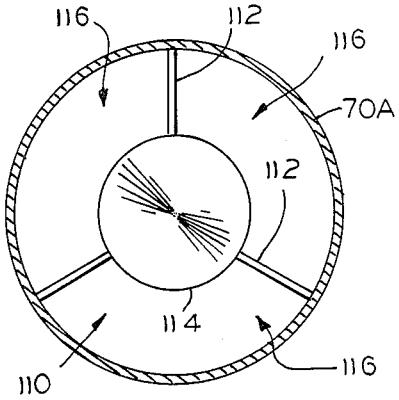
FIG. 10 is a transverse cross-sectional view substantially along line 10—10 of FIG. 9.
Figure 11:
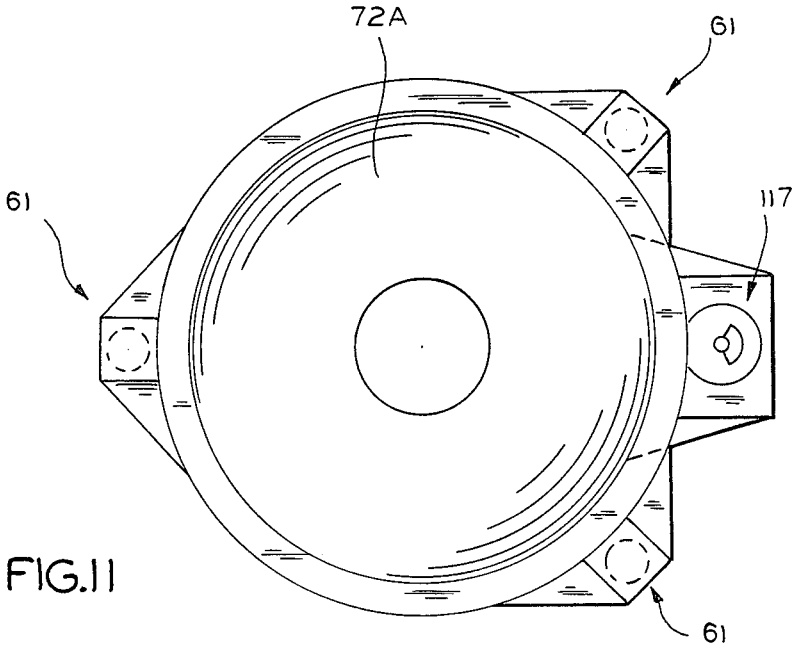
FIG. 11 is a transverse cross-sectional view substantially along line 11—11 of FIG. 9.

The showing of FIGS. 9–11 is concerned with metering activated bins 52A of the one motor type, to which a different form of internal baffling arrangement is applied, as indicated in FIGS. 9 and 10, where this type of metering bin 52A has the three vertically spaced baffles 110, which are spaced apart substantially equally vertically of the bin 52A; the baffles 110 each comprise a central frusto-conical disc member 111 which is fixed by welding or the like to a number of radially oriented rods 112 (three in the illustrated embodiment), which are in turn suitably affixed to the inside surfacing of the bin side wall 70A, as by employing welding techniques or the like. The lowermost baffle 110 is at the "break line" between the bottom of the bin vertical wall 70A, and the top of the bin cone 72A that tapers to the bin discharge opening. The respective baffles 110 thus define between the support rods 112 and along the margin 114 of the respective discs 112 feed through openings 116 that are aligned vertically of the bin 70A.

The orientation of the supporting isolators 61 and vibrating drive assembly 117 including its driving motor, for the bin 52A may be as shown in FIG. 11, and as indicated in FIG. 9, the shaft of the unit drive motor is vertically disposed (with the vibrator eccentrics normally being applied to either end of the illustrated motor shaft), and the bottom of the motor is typiucally flush with the break line between the vertical wall 70 and discharge cone 72A.

Figure 6:
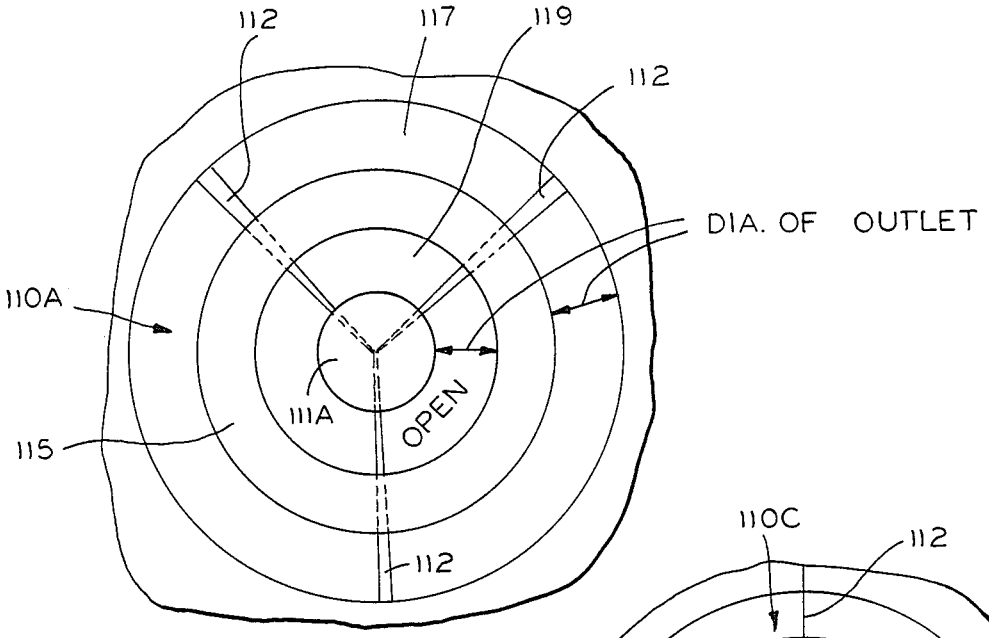
FIGS. 6, 7 and 8 are transverse cross-sectional views comparable to that of FIG. 4 illustrating the activated bin internal baffling employed for bins of increased diameters, with FIGS. 6, 7 and 8 illustrating the arrangement of such baffling for progressively increased diameter bins, as disclosed hereinafter.
Figure 8:
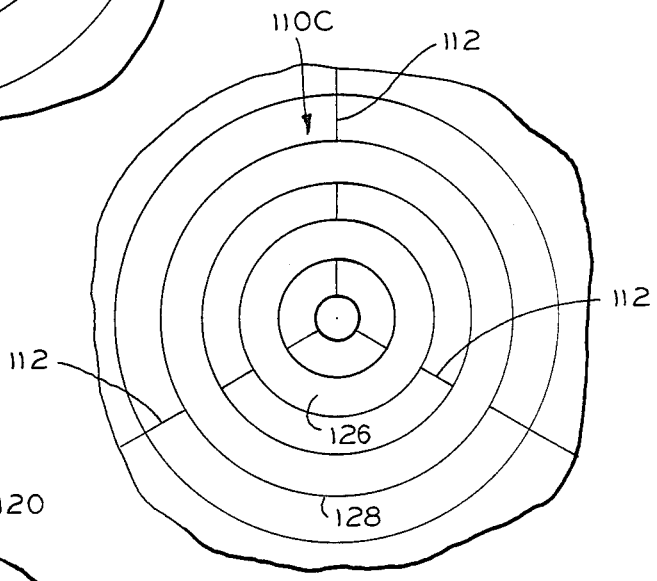
Figure 7:
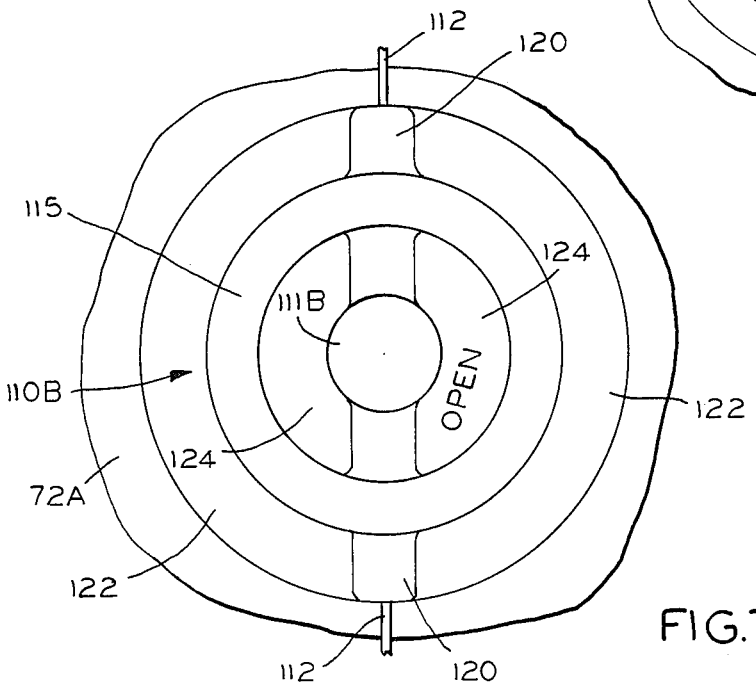

In the showing of FIGS. 6, 7 and 8, modified baffling arrangements are illustrated for successively larger diameter metering bins 52A, with the baffles for the different size bins being proportioned in accordance with the size of the bin 52A.

In the showing of FIG. 6, each baffle arrangement 110A comprises an inner frusto-conical disc 111A and an outer annulus 115 affixed to the radial support rods 112 (see FIG. 10) that extend to the internal side of the bin vertical wall structure (not shown). Defined by the respective baffles 110A are the annular feed through openings 117 and 119.

In the showing of FIG. 7, baffles 110B each comprise the frusto-conical disc 111B that includes a pair of oppositely directed and outwardly directed arms 120 that are respectively affixed to support the annulus 115 that rests on and is affixed to the respective arms 120 for the purpose of defining inner and outer oppositely located feed through apertures 122 and 124, each baffle 110B being supported on the set of radially oriented support rods 112 underlying same. The concept of the arrangement of FIG. 7 is to cover the support rod 112 with the baffle 110B and restrict the connection of the baffle 110B to the bin vertical wall to two points of convection.

In the showing of FIG. 8, the individual baffle arrangements 110C comprise inner and outer annulus defining discs 126 and 128 that are affixed to the respective sets of rods 112 for supporting the three baffle arrangements 110C at the elevations suggested in FIG. 3.

The activated bin baffle arrangements of FIGS. 6 and 7 are preferably employed in activated metering bins 42 and occasionally bins 52 that are in the range of from about eight to about twelve feet in diameter, while the baffle arrangement 110C shown in FIG. 8,is employed in activated bins having a diameter in the range of from about twelve feet to about eighteen feet.

All of the baffle arrangements herein disclosed may be employed in connection with either the single or two motor type activated bins herein disclosed.

VIBRATING CONVEYORS FOR FUEL DISTRIBUTION

The vibrating conveyors 49 comprise basically the upside down vibrating conveyor arrangement offered by Kinergy Corporation of Louisville, Ky. as its Model No. KDC-60-HD(S) but modified as herein disclosed.

As is typical of vibrating conveyors of this type, a conveyor 49 comprises a conveyor trough 130 that defines the feed way 131 for the bulk material being conveyed (in this case RDF), with the trough 130 that defines the way 131 being below the vibrating conveyor counterbalance 132, with the counterbalance 132 being suitably supported on isolator units 133 (see FIG. 16) and actuated by motorized vibrator unit 134. As has been previously indicated, the trough 130 of the vibrating conveyor or ConVeyorS 49 iS flexible connected to the storing bin 42 that services same (which can be by way of a fuel steam splitting as indicated by FIG. 1), and the conveyor or conveyors 49 convey the RDF to the locale of the furnace 44 serviced by same which may be up to 200 feet or so away from the primary storing activated bin 42 that services the furnace 44 in question. As an example, the trough 130 defined by the respective conveyors 49 typically is five feet wide by two feet in height, and at the locale of the furnace 44 serviced thereby the trough floor 136 thereof is formed to define RDF intermediate discharge outlets 138 that may be from three to twelve or so in number, depending on the number of the metering bins 52 that particular vibrating conveyor 49 services.

FIG. 15 diagrammaticaly but more specifically illustrate a typical vibrating conveyor offered by Kinergy Corporation of Louisville, Ky. that has been modified in accordance with the present invention to handle RDF and serve as a distributing conveyor 49. In the showing of FIG. 15, the trough 130 is closed at its top by a dust sealing cover 140 and is otherwise enclosed in a conventional manner to make it dust tight along its length. The usual counterbalance 132 is supported in usual isolator springs 133 that are diagrammatically illustrated in FIG. 16, between the counterbalance bracket structures 135 at the underlying fixed isolator mounts 137. Separating the counterbalance and trough are steel coil type helical drive spring units 139 (omitted from FIG. 16) mounted in angled relation between the brackets 141 and 143 of counterbalance 132 and the trough 130, respectively, for vibrating the trough 130 on actuation of the vibratory drive unit 134, and the usual stabilizer springs 145 are diagrammatically indicated. The angled relation for the drive spring units 139 is made forty-five degrees for this application, as will be discussed hereinafter. As has been indicated, the drive system for the distributing conveyors 49 is, and should be of the so-called "free force" input combined with sub-resonant tuned drive spring type, meaning that the "free force" input is by means of relatively small rotating eccentric weights (usually mounted directly on the shaft of the input motor), and the resonant frequency of the conveyor drive spring units 139 is significantly above the speed of the input motor's forces (as is well known in the art).

As indicated in FIGS. 1 and 23, the inlets 140 of the vibrating conveyors 49 are suitably flexibly connected to the respective primary storing activated bins 42.

In accordance with the present invention, the discharge outlets 138 of the vibrating conveyors 49 each comprise a rectangular opening 142 or port (see FIGS. 15 and 17) formed in the floor 136 of the trough 130 that is to be aligned with the respective metering bins 52 serviced by the particular vibrating conveyor 49 involved. As to the vibrating conveyors 49 illustrated in FIGS. 1 and 15, four such outlet ports 138 of the individual vibrating conveyors 49 service four metering bins 52, while the fifth and downstream most outlet, labeled "open" which also involves a rectangular opening in the trough floor, is fully open, and services the fifth metering bin 52. Applied to the vibrating conveyor trough 130 at each intermediate opening or aperture 142 are spaced apart, planar, and elongate plates 146 that define between and on either side of them spaced feed through apertures 148 (see FIGS. 16 and 17). The individual spaced plates 146 are preferably reinforced longitudinally thereof by the respective cross plates 149 that at their ends are fixed to the trough floor 136 so that the respective plates 146 and their cross bars 149 composit members 149A for each intermediate outlet 138, form a T-bar grid configuration 151 in which the composite T-bars 149A thereof extend longitudinally of the trough 130 and thus in the direction of RDF feed through along its way 131. The spaced plates 146 are upwardly inclined in the direction of free flow, at an angle at about five degrees with respect to the trough floor 136 to form ramps 150, and have their leading edges 157 of greater width (transversely of the trough 130) than their trailing edges 159. As indicated in FIGS. 17 and 18, the ramp plates 146 thus taper from a wider dimension at their leading ends 157 to a narrower dimension at their trailing ends 159, with the typical dimension of their leading ends being approximately two inches and the dimension of their trailing ends being approximately one-half inch in a successful embodiment. The composite members 149A thus define apertures that diverge in the direction of fuel flow for the intermediate outlets 138, with the final outlet 138 being fully open and having no ramp 150. Ramps 150 at the intermediate ports (those upstream of the final open port 138) are preferably on twelve inch centers.

The vibrating conveyor intermediate outlets 138 serve a special function in the handling of RDF, insofar as the transfer of same between the respective conveyors 49 and the respective metering activated bins 52 are concerned. It is important that when the bins 52 serviced by a particular vibrating conveyor 49 are full to the point they cannot accept any more RDF, the RDF being conveyed by the conveyor 49 move on downwardly of the conveyor 49 in question, and this is what happens as the composite members 149A serve as ramps 150 to convey the RDF across the intermediate trough opening 142 involved (which overlies the indicated filled bin 42) so that the RDF continues to move on to the next vibrating conveyor discharge outlet 138 where the same action happens in the event that the metering pin 52 underlying same is filled. Where the RDF is fed over a trough intermediate outlet 138 above a bin 52 that can accept some of the RDF, the RDF passes down through the openings 148 between the composite members 149A and provides the indicated fuel to the bin 52 that needs same. Once that bin 52 fills up, then the RDF conveys over the trough aperture 42 in the manner indicated to the next bin that requires fuel. The Applicant's system contemplates that the RDF can dead end at the last or downstream most outlet 138 defined by a particular vibrating conveyor 49, and the vibrating feeder involved will simply keep operating without damage to its drive system; when the metering bin 52 underlying the downmost stream outlet port 138 becomes empty enough to receive RDF, the backed up RDF then descends to the metering bin in question. This non-damaging feature of conveyors 49 attribute to the vibratory drive involved being of the aforementioned "free force" input combined with sub-resonant tuned springs type.

The conveyor intermediate outlets 138 and their ramps 150 serve the dual functions of facilitating the conveyance of the RDF over the respective intermediate outlets 138 when the activated bins 52 below same are filled, and also induce a fluffing action on the RDF. Thus, the ramps 150 tend to break up any wadding that the RDF has experienced in being processed in accordance with the invention. This is particularly important where the RDF has been stored in a storage bin 42 a significant length of time.

In the electrical system for operating conveyors 49, an overflow switch of any suitable type can be mounted in the trough 130 to shut the conveyor 49 down in the event that all the activated bins 52 it services are filled and the RDF backs up the full length of the conveyor 49 and up into its inlet. In such an arrangement, with the RDF loads of one or more bins 52 emptied enough to start the RDF moving down the ways 131, the indicated overflow switch (not shown) is negated and RDF flow through way 131 is recontinued.

Also, as will be disclosed hereinafter, for the feeders 54, each of the conveyors 49 may have its conveying speed adjusted by adding an adjustable voltage control, following the disclosure of my said U.S. Pat. No. 3,251,457.

THE VIBRATION CONTROL FOR THE ACTIVATED BINS

The showing of FIGS. 12–14 illustrates the manner in which the vibration of both the individual primary storage and metering bins 42 and 52 are controlled. It has been found that for best results, in terms of discharging the RDF from the individual bins 42 and 52 is to insure that they are vibrated as little as reasonably possible. For instance, it has been found that by applying a sizeable dynamic vibrating force for a matter of seconds to a bin 42 or 52 produces far better results in discharging the RDF from the individual bins 42 and 52 than applying a smaller dynamic vibrating force thereto over a longer period of time, the latter being actually detrimental as it tends to pack the fuel in place, as opposed to discharging it from the bin.

For this reason, the present invention contemplates that for each bin 42 and 52 a switch arrangement will be interposed in the electrical system involved which will control the off-on operation of the bin vibrators, in terms of the amount of RDF being conveyed by the respective conveyors 49 serviced by the primary storage bins 42, or the respective vibrating feeders 54 served by the bins 52 in question.

This automatic "cycle type" operation of the bins 42 and 52 is hereinafter specifically described and illustrated in the context of a metering bin 52. However, the same principles are applicable to the primary storage bins 42.

In the form of FIGS. 12 and 13, which also illustrates the downstream most bin 52 when two such bins 52 are employed for redundancy purposes, for serving a particular vibrating feeder 54, incorporated in the electrical wiring providing the electrical energy to the bin exciting devices that are illustrated is a so-called starve switch device 170 that is a mechanical limit switch comprising a dependent rod 172 pivotally mounted as at 174 and having a contact arm 176 affixed thereto for contacting a stationary contact arm 176 as part of the electrical wiring involved. The arrangement is such that when the rod 172 is vertically disposed, as it would be when the RDF flow in the vibrating feeder 54 is below the lower end of the rod 172, the electrical energy is connected to the bin vibrating devices, but when the RDF flow rises to the point that the rod 172 is inclined due to its lower end being moved to the right of FIG. 12, the electrical energy supplied to the vibrating devices of the bin 52 is discontinued. This type of arrangement thus provides for automatic discharge of the respective activated bins 52 into the vibrating feeders 54 they service when needed, and automatic turn off of same when the RDF flow through the feeder is adequate, and having come from one or more other bins 52 serving the feeder 54 in question.

The same arrangement could also be done electrically by photocells looking through windows in the side of the feeder trough and sending a signal therebetween that would recognize whether or not a mat depth of the RDF material was present in the feeder or not.

In the showing of FIG. 14, reference numerals 178 and 180 represent windows formed in the sides of the feeder through which a signal, indicated by the dashed line 182 extends in passing between the electrical photoeye transmitter and receiver that is in electric circuit connection with the bin actuation vibrating devices. Again, when the signal 182 is broken by the flow of the RDF material in the feeder, vibration of the metering bin 52 in question ceases, and vice versa. The devices 170 and 177 are provided for illustrative purposes only, and it is further suggested that capacitor type or even ultrasonic type of devices of this type may be employed if so desired for the same purpose.

A further detail of construction illustrated in the showing of FIGS. 12 and 13 is concerned with the sugar scoop type of chute 184 that may be suitably affixed to the downstreammost activated bin 52 serving a particular vibrating feeder 54. The sugar scoop chute 184 is affixed to the upstream side of the cone 72, of the downstreammost bin 52 serving a particular vibrating feeder 54 and this avoids RDF flow temporarily upstream when the activated bin 52 to which it is applied is actuated. The chute 184 has rounded side portions 185 and a flat midportion 187.

The sugar scoop chute 184 is employed where two activated metering bins 52 per vibrating feeder 54 for redundancy purposes. In any event, the invention contemplates that the upstream most bin 52 serving a particular fibrating feeder 54 discharges RDF against a sloping baffle 189 (see FIG. 2) at the "back" end of the feeder to give the fuel directions downstream of the feeder 54 (to the right of the showing of FIG. 2) the baffle extends crosswise of the feeder trough 200 and be angled relative to the trough floor at about 4 degrees.

THE VIBRATING FEEDERS

The vibrating feeder 54 associated, in accordance with the invention, with one or more of the metering activated bins 52, underlies the bin or bins 52 in any particular RDF arrangement embodying the present invention. In the specific form shown in FIGS. 19 through 22, the vibrating feeder 54 is basically the vibrating feeder Model No. KDF-30-HDDT offered by Kinergy Corporation. The feeder 54 includes the usual dust tight trough 200 (see FIGS. 2, 19 and 23) articulated to counterbalance 202 by way of the usual steel coil drive springs 204, with the counterbalance 202 resting on the usual isolator or mounting springs 206. The counterbalance 202 carries the power input motor that is indicated at 208 including the usual motor housing 210 in which is mounted the driving motor and rotating shaft 212 that has the usual eccentrics 214 at either end of same, one of which is shown in FIG. 19. The trough 200 includes suitable cover 215 and is otherwise suitably enclosed so that the feeders 54 are dust free in operation. As already indicated, the drive system for the vibrating feeders 54 is, and should be, of the so-called "free force" input combined with sub-resonant tuned drive spring type.

In the embodiment illustrated in FIGS. 19–22, the vibrating feeder 54 is mounted within suitable frame 216 on which the metering activated bins 52 of either the one or two motor types are mounted and supported for cooperative operation in accordance with the present invention. As it is desired that the feeder 54 be dust tight, there are provided suitable flexible seals 220 that flexibly connect the discharge cones 72 of the respective bins 52 to the inlets formed in the trough cover 215 that otherwise seals tee top of the trough along the feed path of the RDF to the trough outlet 226 which is connected by a suitable flexible seal 228 to one of the furnace intake chutes 48. In this connection, the outlet 226 of the feeder where the RDF leaves the feeder should be proportioned to fit within the furnace feed chute 48 to insure that all the RDF supplied to the chute 48 is deposited within same.

While diagrammatic FIG. 19 illustrates two bins 52, the number of bins 52 that may be employed is optional, with the length of feeder 54 being in proportion to the number of bins 52 employed.

Referring to FIGS. 2 and 23, these views diagrammatically illustrate an automatic feed control for the vibrating feeders 54. In accordance with this invention, the boiler 46 is equipped with a suitable conventional electrical signaling device 191 which generates an electric signal of 4 to 20 milliamps in accordance with either pressure or temperature within boiler 46 that is generated. The unit 191 is electrically connected by a suitable wiring 192 to an SCR 193 appropriately secured adjacent the motor of the vibrating motor assembly 208. If pressure within the boiler is selected as the controlling medium to be sensed, the sensor 191 is arranged to send its maximum signal at a selected low pressure to increase the vibrating action of feeder 54 to increase the RDF feed to the furnace fire box in question, with the maximum pressure within the boiler that is to be permitted giving the four milliamp signal, whereby the vibrating feeders 54 close down to provide a virtually zero feed into the furnace feed chute it services. The speed of feed provided by the vibrating feeders 54 is thus varied automatically as the SCR 193 senses the signal generated by the pressure in the furnace boiler. Temperature or any other suitable factor sensed within the furnace boiler can alternately be used for the same purpose. Thus, if, for instance, the temperature in the boiler gets too high, the feed rate would need to be reduced, while if the temperature gets too low, then the feed rate needs to increase and this is achieved by employing the teachings of my U.S. Pat. No. 3,251,457. Where the RDF is fed to fluid bed combustors or incinerators, the same sort of automatic feed control is provided. Further, since the vibratory drive system of the vibrating conveyors 49 is the same as the vibratory drive system of the vibratory drive system of the fibrating feeders 54, the fuel feed provided by the conveyors 49 has the same ability to be automatically controlled where that feature would benefit the overall performance of any RDF handling system created in accordance with the present invention. The sensors 191 are standard signal devices available with furnaces offered by, for instance, Babcock & Wilcox and Riley-Stoker Corp.

In accordance with the present invention, the feeders 54 are also equipped with several sets of ramps 230 which are similar to the ramps 230 of the vibrating conveyors 49, but are upwardly angled in the range of from about 10 to aboaut 15 degrees relative to the trough floor 227 (in the direction of feed), rather the five degree angulation 150 of the ramps at the vibrating conveyors.

The ramps 230 are in sets 231 on either side of the way 229 defined by the feeder trough 200, and as indicated in FIGS. 19 and 22, each ramp 230 comprises a pair of base plates 232 affixed to the floor of the trough 200 with each base plate 232 having a ramp plate 234 which is itself angled in shape in the same manner as the plates 146, respectively. Plates 22 are fixed in place, as by welding and plates 230 are similarly fixed in place, along the slanted tops of the plates 232 to have the upwardly angled angulation indicated in FIG. 19, which is to be in the range of from about ten degrees to about fifteen degrees relative to the trough floor 227.

The ramps 230 involve the two ramp plates 234 that are spaced apart and define side edges 236 that converge in the direction of fuel flow, or in other words, the openings between the ramp plates 234 of each eet 231, and the sides 233 of the trough, diverge in the direction of fuel flow. As the RDF moves along the length of the trough 200, the RDF in passing over ramp plates 234 becomes dewadded to the extent that any wadding of the RDF that has occurred up to this point can be removed from the RDF, and the RDF fluffed, prior to being supplied to the furnace 44.

Thus, the ramp sets 230, of which two or three sets (of the sets 231) may be applied along the length of a trough 200 (of the feeders 54) break up and tend to fluff the RDF moving by them. The ramps 230 also tend to smooth out the body of material (its mat depth) moving down the feeder.

As brought out in FIG. 19, the coil drive springs for feeder 54, which are usually formed from a suitable steel, are disposed at 45 degree angles relative to the horizontal. This angulation has been found to be best for all vibrating conveyors and feeders handling RDF because RDF as a body tends to be resilient or rubbery in nature. The 45 degree angulation allows the RDF to be moved at a greater mat depth and at respectable conveying speeds (that is, in the range offrom about five feet per minute to about sixty feet per minute). See FIG. 15 for the application of this principle to vibrating conveyor 49. In this connection, it is pointed out that the 45 degree angulation of the drive springs for the conveyors 49 and the feeders 54 results in the RDF being bounced more per unit of stroke than if the customary 30 degree angulation were employed. This results in the inclined ramps 150 and 230 of the conveyors 49 and feeders 54 respectively performing more effectively to "fluff" the RDF.

As will be apparent, inspection doors or windows can be optionally applied to the feeders 54, as well as to the bins 52 and the large bins 42. The metering bins 52 of FIG. 19 are shown to be provided with suitable inspection doors 240 of a conventional nature, which are normally closed since the entire conveying system is to be dust free.

It will therefore be seen that the RDF handling arrangement disclosed in this application has a number of important advantages.

For instance, the RDF when moved is moved by vibration and the entire feeding action of the system provided by this disclosure tends to "fluff" the fuel up so that it is very loose, which provides for more efficient burning in the furnace.

Furthermore, the entire RDF handling arrangement provided by this disclosure is essentially self cleaning, even though the shapes, sizes, and lengths of the particules making up the fuel vary considerably, and there is no need to periodically shut down the vibrating units involved either regularly or irregularly to manually clean them. All the internal surfaces of the various apparatus forming a part of the system of the instant application are designed to not catch the fuel or provide something for it to wrap around, and this, of course, includes the inverted baffling of the activated bins and the ramp sets of the conveyors 49 and 54. While it sometimes may happen that a long streamer, as from a tape or the like, may happen to drape over the support for the baffling in one of the activated bins, experience has shown that it will eventually fall off and will not require manual removal.

It has also been emphasized that not only is the RDF provided to the furnace fire box on an automatic basis, but it is provided in a steady feed basis that is free of minute flow changes, as would be experienced with the aforereferred to "pulsing" action of augers or partially filled pockets of drag conveyors.

The RDF handling arrangement herein disclosed does not have component parts exposed to the RDF flow stream that require maintenance. All component parts that do require maintenance from time to time are external to the RDF flow stream involved.

The handling arrangement herein disclosed not only is energy efficient in the sense that the total power required to move RFD is only a fraction of that required to power augers or drag conveyors, for instance, and the operating sound level of the various machines involved in the hereindisclosed application operate very quitely; all of the apparatus herein disclosed operate at a total level that is less then 80 dba, it being expected that the actual sound level involved in an operating embodiment of the RDF handling system of the present application would be in the range of from about 65 to about 70 dba.

The vibrating conveyor 49 and the vibrating feeder 54 are inherently adjustable in their output from zero to maximum feed. For this purpose the aforementioned voltage adjustment arrangement (to the input motor) can be taken care of by following the teachings of Dumbaugh U.S. Pat. No. 3,251,457.

An advantage inherent in the apparatus forming the hereindisclosed RDF handling system is that any of the vibrating units disclosed can successfully tolerate repeated and rapid starts and stops without doing damage to the unit drive system or the vibrating unit itself. It has been found, for instance, that the vibrating units in question can start and stop up to five times per minute if necessary.

Another advanaage provided by the hereindisclosed RDF handling arrangement is that the vibrating conveyor 49 which, in accordance with this disclosure is used as a "distributing" conveyor, does avoid the need for any "return" conveyor system to return the fuel to its point of original storage if it is not fed through the discharge ports of the vibrating conveyor.

Also air or hydraulically operated gates at the outlets of both forms of bins 42 and 52 as well as the conveyors 49 and feeders 54 are not needed.

Further, the total initial cost of the equipment comprising my system is about one-half the amount for RDF handling systems using conventional equipment. The operating cost of the equipment comprising my system is also much less than cost of operating conventional equipment for this purpose because of the very low amount of total power consumed and the need for only minimal maintenance.

Yet another important aspect of the invention is that the equipment hereindisclosed is readily made dust-tight.

The foregoing description and the drawings are given merely to explain and illustrate the invention and the invention is not to be limited thereto, except insofar as the appended claims are so limited, since those skilled in the art who have the disclosure before them will be able to make modifications and variations therein without departing from the scope of the invention.

What is claimed is:

1. Apparatus for supplying refuse derived fuel, that has been shredded to a predetermined nominal size to a furnace fuel supply chute that is open to the furnace fire chamber, in a continuous and uninterrupted flow, for heating the furnace boiler, said apparatus comprising:

a large primary surge capacity bin, said bin including an upper intake port and a lower discharge port, means for continuously storing the fuel in said bin at a rate that is substantially in excess of the flow rate of said flow, means for vibrating said primary bin for feeding from the stored fuel quantity the fuel at a predetermined lesser flow rate, a vibrating conveyor including means for receiving the fuel at said lesser flow rate and including a fuel flow conducting trough for vibrationally feeding the fuel received from said primary bin to the locale of the furnace, a metering bin mounted at the locale of the furnace and including an upper intake port and a lower discharge port, means for supplying the fuel from said vibrating conveyor to said metering bin through said upper intake port of said metering bin, a vibrating feeder including means for receiving the fuel from said metering bin through said lower discharge port thereof and extending between said metering bin discharge port and the furnace fuel supply chute and including a fuel flow conducting trough for vibrationally feeding the fuel received from said metering bin to the furnace fuel supply chute, said vibrating conveyor and said vibrating feeder each having a drive system of the free force input combined with sub-resonant tuned spring type, means for vibrating said metering bin for discharging the fuel from the metering bin discharge port onto said vibrating feeder, and means for automatically controlling the vibrating feeder output of said fuel into the furnace feed chute based on heat generated by the fuel burning in the furnace fire chamber.

2. The apparatus set forth in claim 1 including:

means for periodically exciting said primary bin and metering bin vibrating means including means for sensing the level of fuel flow along said vibrating conveyor and said vibrating feeder and actuating the respective said bin vibrating means when said fuel level of said conveyor and feeder, respectively, is below a predetermined elevation.

3. The apparatus set forth in claim 1 wherein:

said bins each include in same vertically spaced inserts each comprising a baffle structure of inverted frusto-conical configuration that defines aperatures for forming internal bin porting that for each bin is disposed to accommodate gravity flow of the fuel therefrom on exciting of said vibrating means thereof.

4. The apparatus set forth in claim 1 wherein:

said means for periodically exciting said bin vibrating means comprises for each bin:

a mechanical limit switch having an actuator rod pivotally mounted adjacent and downsstream of said bin discharge ports, respectively and disposed to be displaced longitudinally of said conveyor and feeder, respectively, by fuel flow therealong.

5. The apparatus set forth in claim 1 wherein:

said means for periodically exciting said bin vibrating means comprises separate electric eye means for sensing the level of fuel flow along said conveyor and feeder, respectively.

6. The apparatus set forth in claim 1 wherein:

said means for supplying the fuel from said vibrating conveyor to said metering bin comprises:

an intermediate discharge port formed in said vibrating conveyor trough over said metering bin intake port and including spaced planar members extending across said port parallel to the direction of fuel flow along said vibrating conveyor and inclined upwardly in said direction of fuel flow.

7. The apparatus set'forth in claim 1 wherein:

said vibrating feeder includes a discharge gate formed in said vibrating feeder includes spaced apart ramp means and inclined upwardly a limited amount in the direction of fuel flow for dewadding of the fuel at the respective sites of said ramp means.

8. The apparatus set forth in claim 1 wherein:

said vibrating conveyor and said vibrating feeder both have stroke angles of forty-five degrees relative to the horizontal.

9. Apparatus for supplying refuse derived fuel, that has been shredded to a predetermined nominal size and usually has had most of the ferrous metals removed therefrom, to a furnace fuel supply chute that leads to the furnace fire chamber for heating the furnace boiler in a continuous and uninterrupted flow, said apparatus comprising a train including at least two metering bins disposed in side-by-side relation and each having an upper intake port and a lower discharge port, a vibrating feeder extending between said metering bin discharge ports and the furnace fuel supply chute, separate vibrating conveyor means for each of said metering bins and each including a fuel flow conducting trough for feeding the fuel thereon to the locale of the respective metering bins and each including a discharge port disposed above the respective metering bin intake ports, means for vibrating the respective bins for discharging the fuel through the respective discharge ports thereof onto said vibrating feeder, means for exciting said metering bin vibrating means including means for sensing the level of fuel flow along said vibrating feeder and actuating said metering bin vibrating means when said fuel level is below a predetermined elevation in said feeder, and means for automatically controlling said vibrating feeder output into the fuel supply chute based on the heat generated by the fuel burning in the furnace fire chamber, said bins each including in same vertically spaced inserts each comprising a baffle structure of inverted frusto-conical configuration apertured to define internal porting that for each of said bins is disposed to accommodate gravity flow of the fuel therefrom on exciting of said vibrating means of the respective bins, whereby should one of said bins fail to operate, the other of said bins can be employed to supply the fuel to said feeder and this to the boiler.

10. The apparatus set forth in claim 9 wherein:

said means for vibrating the respective bins each comprise one vibratory inducing device mounted on the vertical walls of the respective bins, said vibratory device being upright relative to the horizontal.

11. The apparatus set forth in claim 9 wherein:

said means for vibrating the respective bins each comprise several vibratory inducing devices mounted on the vertical walls of the respective bins, said vibratory devices being tilted at approximately forty-five degrees relative to the horizontal.

12. The apparatus set forth in claim 9 wherein:

the metering bin that is located downstream of said feeder relative to the other metering bin thereof has its discharge port equipped with a sugar scoop type chute for directing fuel therefrom downstream of the fuel flow through side vibrating feeder.

13. The apparatus set forth in claim 9 wherein:

said means for automatically controlling said vibrating feeder output comprises means for sensing a signal generated in the furnace boiler when the fuel transmitted to the furnace fire chamber is burned, and means for exciting said feeder in proportion to the signal generated in the boiler.

14. The method of continously supplying refuse derived fuel (RDF) that has been shredded to a predetermined nominal size, to and into the fuel feed chute of a furnace fire chamber, in a continuous and uninterrupted final fuel flow that is free of pulsation for burning of such fuel in the furnace fire chamber, said method comprising:

establishing a first body of said fuel that is rounded about an essentially vertical first axis and is of sufficient volumetric quantity to serve as primary surge capacity storage of such fuel, supplying to said body additional of said fuel in sufficient quantity to maintain the primary storage capacity of said first body, periodically subjecting said fuel body, as a whole, to a period of vibration having an oscillation resultant that includes as a component vibratory motion about said vertical axis and thereby orienting the components making up the fuel of said fuel body in horizontal layers and discharging therefrom a first flow of said fuel, vibrationally conveying the first fuel flow to the locale of the furnace and binning such fuel flow into the form of a second fuel body that is rounded about an essentially vertical second axis and is of lesser quantity than that of said first body, periodically subjecting said second fuel body, as a whole, to a period of vibration having an oscillation resultant that includes as a component vibratory motion about said second vertical axis and thereby orienting the components making up the fuel of said second fuel body in horizontal layers and discharge therefrom a second flow of said fuel, vibrationally feeding the second fuel flow to the fuel feed chute at a feed rate that is automatically controlled to form the continuous and uninterrupted flow of same that is free of pulsation, and discharging said final fuel flow into the fuel feed chute.

15. The method set forth in claim 14 wherein:

the fuel of said fuel flows is maintained in a fluffed condition in practicing said vibrational conveying and vibrational feeding steps.

16. The method set forth in claim 14 wherein:

the conveying of said first fuel flow in practicing said vibrational conveying step is effected employing a vibrating conveyor which has a drive system of the free force input combined with sub-resonant tuned springs type.

17. The method set forth in claim 14 wherein:

the feeding of said second fuel flow in practicing said vibrational feeding step is effected employing a vibrating feeder which has a drive system of the free force input combined with sub-resonant tuned spring type.

18. The method set forth in claim 14 wherein:

in practicing the vibrational feeding step the feed rate is proportional to the heat generated by the rate of burn up of said fuel in the furnace fire chamber.

19. Apparatus for supplying refuse derived fuel, that the been shredded to a predetermined nominal size, to a furnace fuel feed chute that is open to the furnace fire chamber, in a continous and uninterrupted flow, for burning of such fuel in the furnace fire chamber, said apparatus comprising:

a large primary surge capacity bin, said bin including an upper intake port and a lower discharge port, means for continously storing the fuel in said bin through said intake port at a rate that is substantially in excess of the flow rate of said flow, means for periodically vibrating said primary bin for feeding from the stored fuel quantity through said discharge port the fuel at a predetermined lesser flow rate, fuel distributing conveyor means below said primary bin and comprising a vibrating conveyor including means for receiving the fuel from said primary bin discharge port at said lesser flow rate and including a fuel flow conducting trough for vibrationally conveying such fuel flow received from said primary bin to the locale of the furnace, a series of metering bins mounted at the locale of the furnace and each including an upper intake port and a lower discharge port, means for supplying the fuel from said v ibrating conveyor to said metering bins through said upper intake port of said metering bins, means for vibrating said metering bins for discharging the fuel from the respective discharge ports thereof, a vibrating feeder below said metering bins and including means for receiving the fuel from said metering bins extending between said metering bin discharge ports and the furnace fuel supply chute and including a fuel flow conducting trough for vibrationally feeding the fuel received from said metering bins to the furnace fuel supply chute, and means for automatically controlling the fuel output of said vibrating feeder into the furnace feed chute based on heat generated by the fuel burning in the furnace fire chamber, said vibrating conveyor and said vibrating feeder each having a drive system of the free force input combined with sub-resonant tuned spring type.

20. The apparatus set forth in claim 19 including:

means for periodically exciting said primary bin and metering bin vibrating means including means for sensing the level of fuel flow along said vibrating conveyor and said vibrating feeder and actuating the respective said bin vibrating means when said fuel level of said conveyor and feeder, respectively, is below a predetermined elevation.

21. The apparatus set forth in claim 19 wherein:

said bins each include in same vertically spaced inserts each comprising a baffle structure of inverted frusto-conical configuration that defines aperatures for forming internal bin porting that for each bin is disposed to accommodate gravity flow of the fuel therefrom on the exciting of said vibrating means thereof.

22. The apparatus set forth in claim 19 wherein:

said means for periodically exciting said bin vibrating means comprises for each bin:

a mechanical limit switch having an acutator rod pivotally mounted adjacent and downstream of said bin discharge ports, respectively and disposed to be displaced longitudinally of said conveyor and feeder, respectively, by fuel flow therealong.

23. The apparatus set forth in claim 19 wherein:

said means for periodically exciting said bin vibrating means comprises a separate electric means for sensing the level of fuel flow along said conveyor and feeder, respectively.

24. The apparatus set forth in claim 19 wherein:

said means for supplying the fuel from said vibrating conveyor to said metering bin comprises:

an intermediate discharge port formed in said vibrating conveyor trough over said metering bin intake port and including spaced planar members extending across said port parallel to the direction of fuel flow along said vibrating conveyor and inclined upwardly in said direction of fuel flow.

25. The apparatus set forth in claim 19 wherein:

said vibrating feeder includes spaced apart ramp means and inclined upwardly a limited amount in the direction of fuel flow in said vibrating feeder for dewadding of the fuel at the respective sites of said ramp means.

26. The apparatus set forth in claim 19 wherein:

said vibrating conveyor and said vibrating feeder both have stroke angles of at least forty degrees relative to the horizontal.

* * * * *